US009287105B2

(12) United States Patent
Kawaguchi et al.

(10) Patent No.: US 9,287,105 B2
(45) Date of Patent: Mar. 15, 2016

(54) MASS SPECTROMETRIC SYSTEM

(71) Applicant: Hitachi High-Technologies Corporation, Minato-ku, Tokyo (JP)

(72) Inventors: Yohei Kawaguchi, Hachioji (JP); Yuichiro Hashimoto, Tachikawa (JP); Masuyuki Sugiyama, Hino (JP); Shun Kumano, Kokubunji (JP); Akihito Kaneko, Kawasaki (JP); Masahito Togami, Higashiyamato (JP); Kazushige Nishimura, Kokubunji (JP); Hiroyuki Inoue, Kashiwa (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 13/760,284

(22) Filed: Feb. 6, 2013

(65) Prior Publication Data

US 2013/0228677 A1 Sep. 5, 2013

(30) Foreign Application Priority Data

Mar. 2, 2012 (JP) ..... 2012-047202

(51) Int. Cl.
*H01J 49/26* (2006.01)
*H01J 49/00* (2006.01)

(52) U.S. Cl.
CPC ..... *H01J 49/26* (2013.01); *H01J 49/0031* (2013.01); *H01J 49/0036* (2013.01)

(58) Field of Classification Search
CPC ... H01J 49/0036; H01J 49/26; H01J 49/0031; G01N 30/8637; G01N 30/8675; G01N 30/8631; G01N 30/8693; G01N 30/8679; G01N 30/72; G01N 30/8644
USPC ..... 250/281, 282; 702/27
See application file for complete search history.

(56) References Cited

U.S. PATENT DOCUMENTS 5,121,443 A * 6/1992 Tomlinson ..... G01N 30/8624 210/656
5,670,370 A * 9/1997 Molin et al. ..... 435/6.18
5,670,379 A * 9/1997 Ito et al. ..... G01N 30/82 210/198.2

(Continued)

FOREIGN PATENT DOCUMENTS

EP 1 717 586 A1 11/2006
JP 2006-138755 A 6/2006

(Continued)

OTHER PUBLICATIONS

Extended European Search Report issued in counterpart European Application No. 13154713.5 dated Oct. 28, 2015 (Four (4) pages).

*Primary Examiner* — Wyatt Stoffa
(74) *Attorney, Agent, or Firm* — Crowell & Moring LLP

(57) ABSTRACT

There is a tendency of the intensity and the shape of a spectrum to be measured transitioning with the passage of measured time, depending on the volatility and the reactivity of a component. A mass spectrometric system includes: a mass spectrometric unit that measures a specimen and outputs a mass spectrum; and an estimator that has an estimation rule on content information, the estimation rule being assigned to each component and each measurement time. The estimator estimates, based on a mass spectrum output from the mass spectrometric unit, content information on each component of a plurality of components that may be contained in the specimen in accordance with the estimation rule.

9 Claims, 38 Drawing Sheets

(56) References Cited

U.S. PATENT DOCUMENTS 5,859,362 A 1/1999 Neudorfl et al.
6,873,915 B2 * 3/2005 Hastings ..... G01N 30/8624 250/282
7,072,772 B2 * 7/2006 Ahmed ..... H01J 49/40 250/399
7,158,893 B2 * 1/2007 Yoshinari ..... G06F 19/16 250/252.1
7,501,621 B2 * 3/2009 Willis ..... H01J 49/40 250/281
7,538,321 B2 * 5/2009 Ishimaru ..... G01N 30/8675 250/281
7,825,373 B2 * 11/2010 Willis ..... H01J 49/40 250/281
7,904,253 B2 * 3/2011 Wang ..... H01J 49/0036 250/281
7,982,181 B1 * 7/2011 Senko ..... G01N 30/72 250/281
2002/0010566 A1 * 1/2002 Chester ..... G01N 30/8693 703/2
2002/0074490 A1 * 6/2002 Umemura ..... 250/288
2003/0159523 A1 8/2003 Renfro
2003/0236636 A1 * 12/2003 Yoshinari ..... G06F 19/16 702/27
2004/0199336 A1 * 10/2004 Ito ..... G01N 30/8624 702/32
2005/0063864 A1 3/2005 Sano et al.
2005/0267689 A1 * 12/2005 Tsypin ..... G01N 33/6848 702/19
2006/0075806 A1 * 4/2006 Gilby ..... G01N 30/82 73/61.57
2006/0195271 A1 * 8/2006 Park ..... H01J 49/0036 702/27
2006/0219893 A1 10/2006 Nishihira et al.
2006/0255263 A1 11/2006 Ishimaru et al.
2006/0289735 A1 12/2006 Ohtake et al.
2007/0138384 A1 * 6/2007 Keiser ..... H01J 49/0031 250/282
2008/0052011 A1 * 2/2008 Wang ..... H01J 49/0036 702/27
2008/0128607 A1 * 6/2008 Herold ..... G01N 30/72 250/282
2009/0014642 A1 * 1/2009 Willis ..... H01J 49/40 250/282
2009/0057550 A1 * 3/2009 Stults ..... G06F 19/24 250/282
2009/0136139 A1 * 5/2009 Kataoka ..... G06K 9/00503 382/207
2009/0209047 A1 * 8/2009 Kiernan ..... G01N 33/6893 436/501
2010/0100336 A1 * 4/2010 Wright ..... G01N 30/8624 702/32
2010/0198524 A1 * 8/2010 Brown ..... G01J 3/28 702/27
2010/0288918 A1 11/2010 Satulovsky
2010/0299078 A1 * 11/2010 Guieze ..... G01N 30/8675 702/24
2011/0098940 A1 * 4/2011 Ito ..... G01N 30/8624 702/32
2012/0112059 A1 * 5/2012 Sugiyama ..... H01J 49/004 250/282
2012/0267522 A1 * 10/2012 Geromanos ..... G01N 33/6848 250/282
2013/0131998 A1 * 5/2013 Wright ..... H01J 49/0036 702/27
2013/0282293 A1 * 10/2013 Geromanos ..... G01N 33/6848 702/19
2014/0303903 A1 * 10/2014 Fujita ..... H01J 49/0036 702/23

FOREIGN PATENT DOCUMENTS

JP 2006-317326 A 11/2006
JP 2007-10683 A 1/2007
JP 2010-54406 A 3/2010
JP 2011-23184 A 2/2011
JP 2011-33346 A 2/2011
WO WO 2011/058381 A1 5/2011

* cited by examiner

Fig. 7

| Measurement time | Component | Measurement operation | Estimation rule No. k |
|---|---|---|---|
| 0 sec. or longer Shorter than 10 sec. | Component X | $MS^1$ | 1 |
| 10 sec. or longer Shorter than 30 sec. | Component X | $MS^2$ (m/z 180) | 2 |
| 30 sec. or longer | Component X | $MS^1$ | 3 |
| ⋮ | ⋮ | ⋮ | ⋮ |
| 180 sec. or longer | Component Z | $MS^2$ (m/z 194) | K |

701

Estimation rule No. 1
Concentration estimation

| No. m | m/z | Coefficient | Reference material m/z |
|---|---|---|---|
| 1 | 180 | 0.008 | 164 |
| 2 | 163 | 0.002 | 164 |

702

Estimation rule No. 2
Concentration estimation

| No. m | m/z | Coefficient | Reference material m/z |
|---|---|---|---|
| 1 | 180 | 0.03 | 164 |
| 2 | 163 | 0.02 | 164 |

703

Estimation rule No. 3
Concentration estimation

| No. m | m/z | Coefficient | Reference material m/z |
|---|---|---|---|
| 1 | 180 | 0.03 | 164 |
| 2 | 163 | 0.0001 | None |
| 3 | 194 | -0.00008 | None |

Fig. 8

801

| Measurement time | Component | Measurement operation | Threshold | Estimation rule No. k |
|---|---|---|---|---|
| 0 sec. or longer Shorter than 10 sec. | Component X | $MS^1$ | 0.5 | 1 |
| 10 sec. or longer Shorter than 30 sec. | Component X | $MS^2$ (m/z 180) | 0.5 | 2 |
| 30 sec. or longer | Component X | $MS^1$ | 0.4 | 3 |
| ⋮ | ⋮ | ⋮ | ⋮ | ⋮ |
| 180 sec. or longer | Component Z | $MS^2$ (m/z 194) | 0.4 | K |

Estimation rule No. 1
Existence determination

| No. m | m/z | Coefficient | Reference material m/z |
|---|---|---|---|
| 1 | 180 | 0.008 | 164 |
| 2 | 163 | 0.002 | 164 |

Estimation rule No. 2
Existence determination

| No. m | m/z | Coefficient | Reference material m/z |
|---|---|---|---|
| 1 | 180 | 0.03 | 164 |
| 2 | 163 | 0.02 | 164 |

Estimation rule No. 3
Existence determination

| No. m | m/z | Coefficient | Reference material m/z |
|---|---|---|---|
| 1 | 180 | 0.03 | 164 |
| 2 | 163 | 0.0001 | None |
| 3 | 194 | -0.00008 | None |

Fig. 9

| Measurement time | Component | Measurement operation | Order threshold | Estimation rule No. k |
|---|---|---|---|---|
| 0 sec. or longer Shorter than 10 sec. | Component X | $MS^1$ | Within 5th | 1 |
| 10 sec. or longer Shorter than 30 sec. | Component X | $MS^2$ (m/z 180) | Within 5th | 2 |
| 30 sec. or longer | Component X | $MS^1$ | Within 5th | 3 |
| ⋮ | ⋮ | ⋮ | ⋮ | ⋮ |
| 180 sec. or longer | Component Z | $MS^2$ (m/z 194) | Within 1st | K |

Estimation rule No. 1
Existence determination based on concentration order

| No. m | m/z | Coefficient | Reference material m/z |
|---|---|---|---|
| 1 | 180 | 0.008 | 164 |
| 2 | 163 | 0.002 | 164 |

Estimation rule No. 2
Existence determination based on concentration order

| No. m | m/z | Coefficient | Reference material m/z |
|---|---|---|---|
| 1 | 180 | 0.03 | 164 |
| 2 | 163 | 0.02 | 164 |

Estimation rule No. 3
Existence determination based on concentration order

| No. m | m/z | Coefficient | Reference material m/z |
|---|---|---|---|
| 1 | 180 | 0.03 | 164 |
| 2 | 163 | 0.0001 | None |
| 3 | 194 | -0.00008 | None |

| 1501 | 1502 |
|---|---|
| Stimulant Methamphetamine | 1ppm |
| Stimulant Amphetamine | 0 |
| Synthetic narcotic MDMA | 0.5ppm |
| Synthetic narcotic MDA | 0 |

| 1601 | 1602 |
| --- | --- |
| Stimulant Methamphetamine | Positive |
| Synthetic narcotic MDMA | Negative |

Fig. 22

| 2201 | 2202 | 2203 |
|---|---|---|
| Stimulant Methamphetamine | Positive | 0.995 |
| Synthetic narcotic MDMA | Negative | 0.99 |

Fig. 29

2901

| Measurement time | Component | Measurement operation | Certainty weight | Estimation rule No. k |
|---|---|---|---|---|
| 0 sec. or longer Shorter than 10 sec. | Component X | $MS^1$ | | 1 |
| 10 sec. or longer Shorter than 30 sec. | Component X | $MS^2$ (m/z 180) | | 2 |
| 30 sec. or longer | Component X | $MS^1$ | | 3 |
| ⋮ | ⋮ | ⋮ | ⋮ | ⋮ |
| 180 sec. or longer | Component Z | $MS^2$ (m/z 194) | | K |

Estimation rule No. 1
Concentration estimation

| No. m | m/z | Coefficient | Reference material m/z |
|---|---|---|---|
| 1 | 180 | 0.008 | 164 |
| 2 | 163 | 0.002 | 164 |

Estimation rule No. 2
Concentration estimation

| No. m | m/z | Coefficient | Reference material m/z |
|---|---|---|---|
| 1 | 180 | 0.03 | 164 |
| 2 | 163 | 0.02 | 164 |

Estimation rule No. 3
Concentration estimation

| No. m | m/z | Coefficient | Reference material m/z |
|---|---|---|---|
| 1 | 180 | 0.03 | 164 |
| 2 | 163 | 0.0001 | None |
| 3 | 194 | -0.00008 | None |

Fig. 40

| | |
|---|---|
| Specimen acquisition time | 16:00:10 |
| Current time | 16:05:21 |
| Elapsed time from specimen acquisition | 05:11 |

MASS SPECTROMETRIC SYSTEM

CLAIM OF PRIORITY

The present application claims priority from Japanese patent application JP 2012-047202 filed on Mar. 2, 2012, the content of which is hereby incorporated by reference into this application.

BACKGROUND OF THE INVENTION

1. Field of the Invention

The present invention relates to a mass spectrometric system.

2. Background Art

A system including a mass spectrometer to measure a specimen and estimating "content information" on each component of a plurality of components that may be contained in the specimen is widely available. The "content information" herein means concentration of a target component in the specimen, a logical value indicating whether the concentration of a target component exceeds a certain threshold or not, the order of concentration among target components, a logical value indicating whether the order of concentration among target components exceeds a certain order or not or values derived from these values.

JP Patent Publication (Kokai) No. 2010-54406 A (Patent Document 1) as background art in this technical field mentions in paragraph 0008, "a peak appearing in a reference mass spectrum that is known for a target compound is compared with a peak having the same mass-to-charge ratio, m/z value, as that of the peak in the reference mass spectrum, the peak appearing in an actually-measured mass spectrum at each time in a predetermined time range around the time when the target compound appears. A shape of a chromatogram peak of the target compound is estimated using an intensity ratio of the peak at each time, and the existence or not of the target compound is determined on the basis of the shape of the estimated chromatogram peak".

JP Patent Publication (Kokai) No. 2011-33346 A (Patent Document 2) also is available. According to this publication, each peak appearing in an actually-measured mass spectrum at a designated time is examined as to whether a peak top of the mass chromatogram of the m/z thereof exists or not in a predetermined time range before and after a designated time. When the peak top exists, the spectrum peak of the m/z is determined as a pure peak due to a single compound only and when the peak top does not exist in such a range, the spectrum peak is determined as an impurity peak. Using the pure peak only, a reference mass spectrum of a known compound is multiplied by a constant so as to perform fitting to the actual mass spectrum, and an intensity of an impurity peak exceeding the reference mass spectrum is corrected to the spectrum. As a result, the actual mass spectrum with reduced influences of impurity components can be obtained, and using this spectrum, a similarity to the reference mass spectrum of a known compound is calculated.

SUMMARY OF THE INVENTION

There is a tendency of the intensity and the shape of a spectrum to be measured transitioning with the passage of measured time, depending on the volatility and the reactivity of a component.

Since a target compound changes in the intensity and the shape of a spectrum with the passage of the measurement time, the data analysis method using the chromatograph mass spectrometry of Patent Document 1 will fail to estimate the content information. For instance, in the case of a m/z having a small ratio between the peak intensity of the "actually-measured mass spectrum" and the peak intensity of the "known reference mass spectrum", the reason for a different shape of a spectrum of the target compound cannot be specified because such a difference shape may be due to a small intensity of the chromatogram of the target compound, a small influence of an impurity compound, or the actually-measured mass spectrum being measured at a different measurement time from that of the reference mass spectrum. Therefore, it becomes difficult to estimate the chromatogram, and accordingly it becomes difficult to estimate content information based on the comparison thereof. Further combination with gas chromatography or liquid chromatography is must for identification based on the comparison of chromatogram.

Since a target compound changes in the intensity and the shape of spectrum with the passage of the measurement time, the data analysis method using the chromatograph mass spectrometry of Patent Document 2 will fail to estimate the content information. For instance, even when the influence of an impurity component can be completely removed from the actually-measured mass spectrum, the reason for a low similarity cannot be specified because such a low similarity may be due to the measurement of different compounds or different shapes of spectra because the "actually-measured mass spectrum" and the "reference mass spectrum of the known compound" are measured at different times. Further, in order to determine whether the peak is a pure peak or an impurity peak based on "the peak existing in a predetermined time range or not", combination with gas chromatography or liquid chromatography is must.

Then, it is an object of the present invention to provide a mass spectrometric system capable of estimating content information precisely even when a spectrum to be measured has a tendency of transitioning in the intensity or the shape with the passage of measured time.

In order to fulfill this object, a mass spectrometric system of the present invention may include: a mass spectrometric unit that measures a specimen and outputs a mass spectrum; and an estimator that has an estimation rule on content information, the estimation rule being assigned to each component and each measurement time. The estimator may estimate, based on a mass spectrum output from the mass spectrometric unit, content information on each component of a plurality of components that may be contained in the specimen in accordance with the estimation rule.

Effects of the Invention

The present invention can provide a mass spectrometric system capable of estimating content information precisely even when a spectrum to be measured has a tendency of transitioning in the intensity or the shape with the passage of measured time.

The problems, configurations and effects other than those described above will be made clear by the following descriptions of embodiments.

BRIEF DESCRIPTION OF THE DRAWINGS

FIG. 7 shows an exemplary data structure of an estimation rule database of the present invention.

FIG. 8 shows another exemplary data structure of an estimation rule database of the present invention.

FIG. 9 shows still another exemplary data structure of an estimation rule database of the present invention.

FIG. 22 shows another exemplary graphical user interface of the estimation result presentation unit of the present invention.

FIG. 29 shows another exemplary graphical user interface of the estimation rule database of the present invention.

FIG. 40 shows an exemplary graphical user interface of a specimen acquisition time input unit of the present invention.

DESCRIPTION OF A PREFERRED EMBODIMENT OF THE INVENTION

The following describes embodiments, with reference to the drawings.

Embodiment 1

The present embodiment describes an exemplary mass spectrometric system capable of estimating content information precisely even when a spectrum to be measured has a tendency of transitioning in the intensity or the shape with the passage of measured time.

As stated above, the "content information" means concentration of a target component in the specimen, a logical value indicating whether the concentration of a target component exceeds a certain threshold or not, the order of concentration among target components, a logical value indicating whether the order of concentration among target components exceeds a certain order or not or values derived from these values. The "concentration" herein means an absolute concentration value or a relative concentration value that is obtained by normalization with a reference concentration corresponding to each component.

For instance, the present embodiment may be a mass spectrometric system to detect a drug in a specimen.

Figure 1:
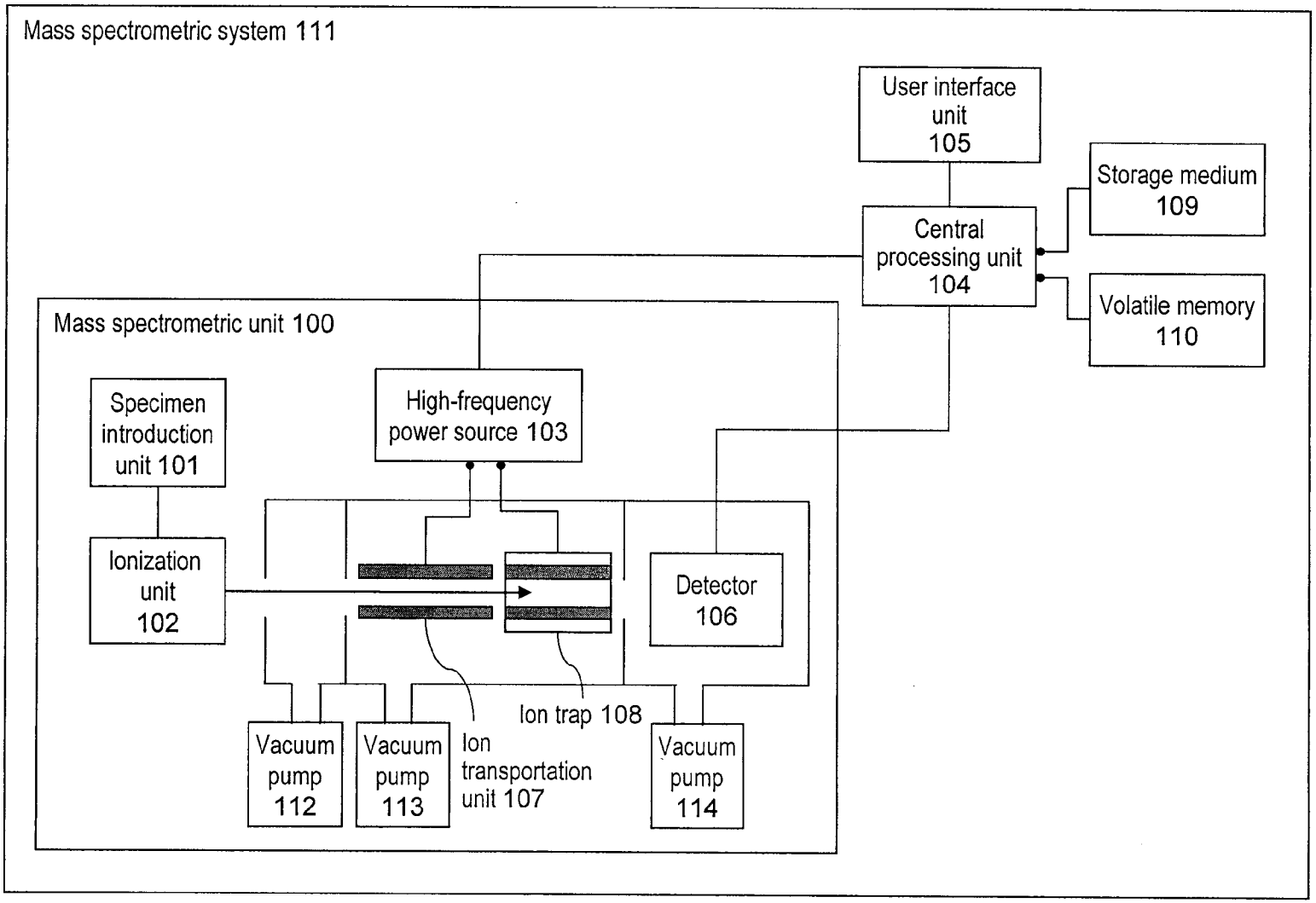
FIG. 1 shows an exemplary hardware configuration of a mass spectrometric system of the present invention.

FIG. 1 shows a hardware configuration of a mass spectrometric system 111 of the present embodiment. The mass spectrometric system 111 of the present embodiment includes a specimen introduction unit 101, an ionization unit 102, a high-frequency power source 103, a central processing unit 104, a monitor 105, a detector 106, an ion transportation unit 107, an ion trap 108, a storage medium 109, a volatile memory 110 and vacuum pumps 112 to 114. The vacuum pumps 112 to 114 keep appropriate pressure in a chamber connected to each of theses pumps.

Vapor, droplet spray or micro-particulate specimen is introduced from the specimen introduction unit 101, and the introduced specimen is sent to the ionization unit 102 including an ion source for ionization. The ionization method here may be an electro-spray ionization method or a sonic spray ionization method, for example. These ions are sent from the ionization unit 102 to the ion trap 108 via the ion transportation unit 107. The ion trap 108 may be a quadruple ion trap or a linear trap. The high-frequency power source 103 supplies high-frequency voltage to the ion trap 108 to let the ion trap 108 trap ions inside.

The central processing unit 104 changes high-frequency voltage applied to the ion trap 108 with time, whereby ions are sent to the detector 106 at a different time in accordance with the m/z. The detector 106 converts the amount of arrived ions into a voltage value, and sends the same to the central processing unit 104. The central processing unit 104 converts time of a time-series voltage signal into m/z of ions, thus replacing with intensity-series data (called a mass spectrum) representing the amount of ions for each m/z, and stores the same in the volatile memory 110. The mass spectrum is stored as the form of a M-element array X=(x_1, . . . , x_M).

On the basis of the mass spectrum stored in the volatile memory 110, the central processing unit 104 performs estimation processing of content information on components. This processing is executed in accordance with an estimation rule stored in the storage medium 109. The monitor 105 presents the estimated content information. The monitor 105 may be a monitor via another PC connected via a network.

Figure 2:
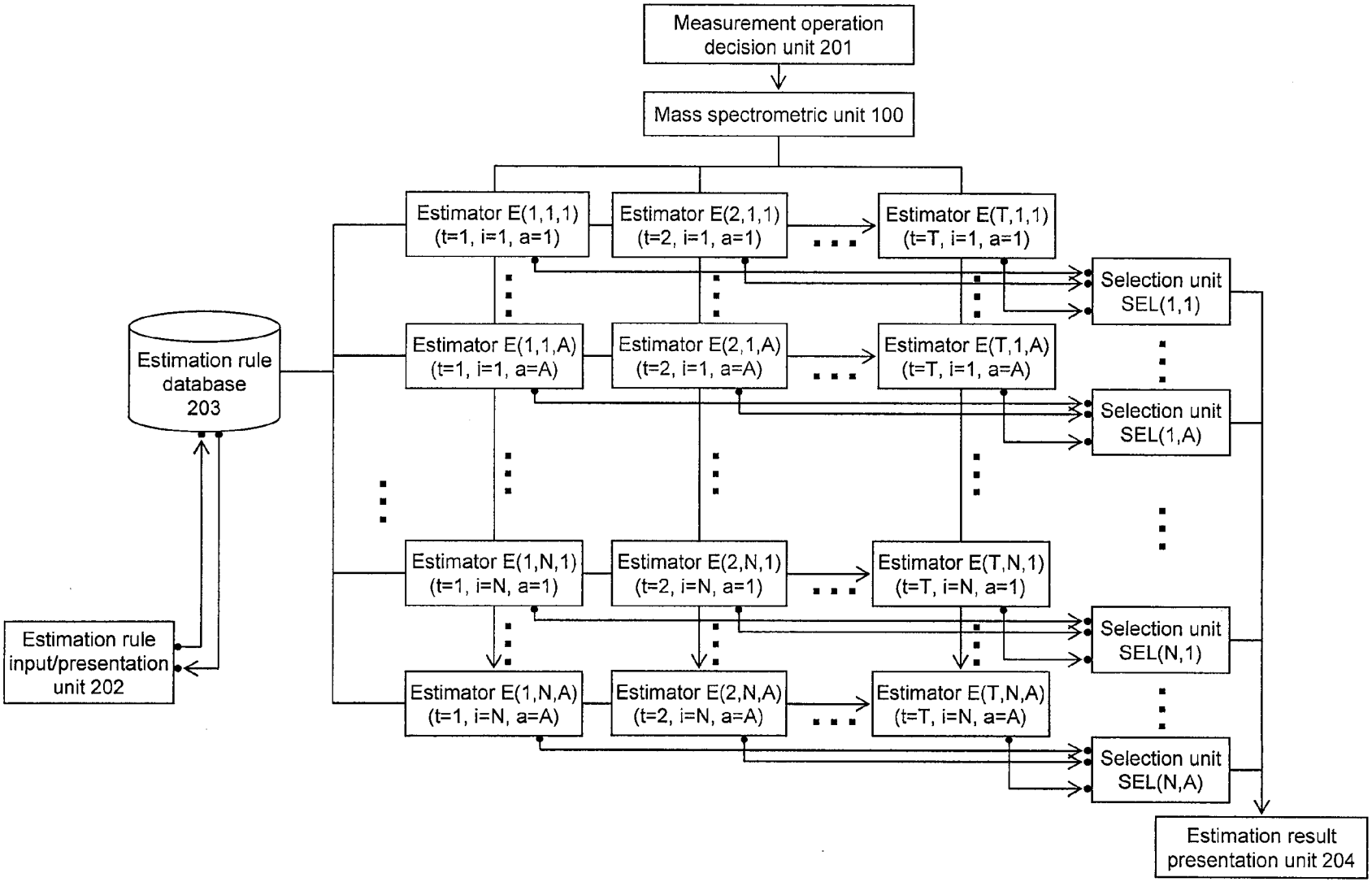
FIG. 2 shows an exemplary processing block configuration of a mass spectrometric system of the present invention.

FIG. 2 shows a processing block configuration of the mass spectrometric system 111 of the present embodiment.

An estimation rule input/presentation unit 202 accepts an estimation rule corresponding to each time, each component and each measurement operation that is input by a user, and stores such a rule in an estimation rule database 203. The estimation rule input/presentation unit 202 presents each estimation rule stored in the estimation rule database 203 to a user.

A measurement operation decision unit 201 decides a measurement operation to be performed next, and outputs a control sequence corresponding to the measurement operation. The control sequence is time-series voltage to be applied to a plurality of electrodes, including four steps of an accumulating step, a cooling step, a mass scanning step, and a releasing step. For instance, the control sequence may be the same as that disclosed in JP Patent Publication (Kokai) No. 2011-23184 A (Patent Document 3).

A mass spectrometric unit 100 executes mass spectrometry in accordance with a control sequence input. As stated above, the mass spectrometric unit outputs a spectrum.

An estimator E(t, i, a) receives a spectrum as an input, and when the spectrum is measured at a measurement time t by the execution of a measurement operation a and the measurement operation a measures a component i as a measurement target, estimates content information on the component i. The content information may be a label value res(t, i, a)={positive, negative} as an existence determination result or a real value d(t, i, a) as a concentration estimation value. When the measurement operation a is executed at the measurement time t and the measurement operation a measures the component i as a measurement target, 1 is stored as valid flag (t, i, a), and otherwise 0 is stored as the valid flag (t, i, a). In the case of existence determination, res(t, i, a) and valid (t, i, a) are output, and in the case of concentration estimation, d(t, i, a) and valid (t, i, a) are output. The estimator E(t, i, a) executes estimation using an estimation rule corresponding to each time t, each component i and each measurement operation a.

A selection unit SEL(i, a) outputs any one of the existence determination result res(t, i, a) and the concentration estimation value d(t, i, a) corresponding to the latest time t with valid (t, i, a)=1 as a new estimation result res(i, a) or d(i, a).

An estimation result presentation unit 204 presents the existence determination result res(i, a) or the concentration estimation value d(i, a) corresponding to each component i and each measurement operation a input to a user. A method of the presentation may be presentation of image information via the monitor 105, presentation by sound, printing of image information via a printer or the like.

Figure 3:
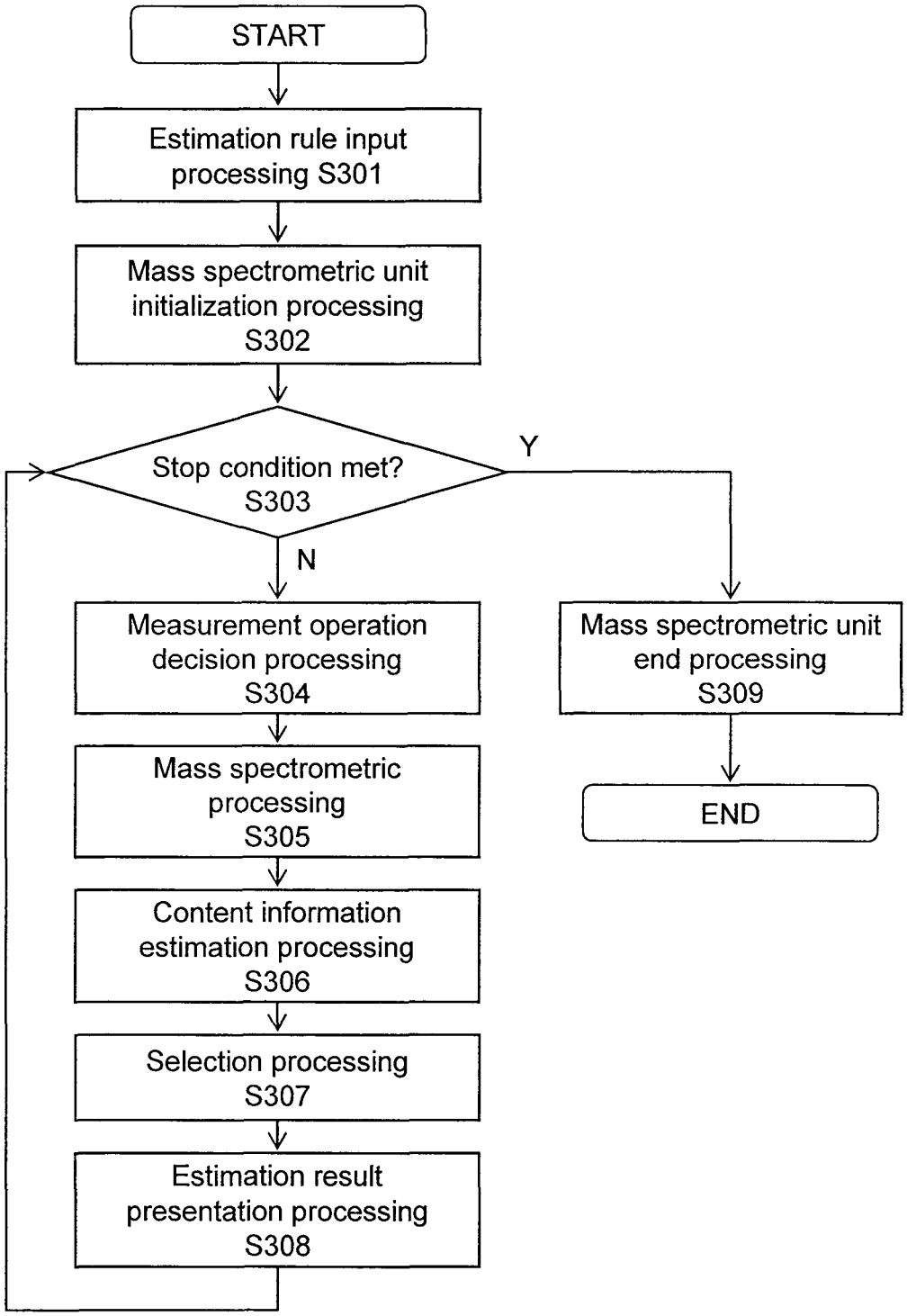
FIG. 3 is an exemplary flowchart of the operation of a mass spectrometric system of the present invention.

FIG. 3 is a flowchart of the operation of the mass spectrometric system 111 of the present embodiment.

Firstly, following the activation of the mass spectrometric system 111 of the present embodiment, at S301, estimation rule input processing is executed. In the estimation rule input processing, the aforementioned estimation rule input/presentation unit 202 accepts an estimation rule corresponding to each time, each component and each measurement operation input by a user, and stores the rule in the estimation rule database 203. Next, at Step S302, mass spectrometric unit initialization processing is executed. Next, at S303, determination is made as to whether a stop condition is met or not. The stop condition may be acceptance of a stop operation from a user, detection of a measurement error or execution of mass spectrometry a predetermined number of times, for example. When the stop condition is met, mass spectrometric unit end processing at S309 is executed and the procedure ends. When the stop condition is not met, steps from S304 to S308 are executed. In measurement operation decision processing at S304, the aforementioned measurement operation decision unit 201 decides a measurement operation to be performed next, and outputs a control sequence corresponding to the measurement operation. Next, in mass spectrometric processing at S305, the aforementioned mass spectrometric unit 100 executes mass spectrometry in accordance with the control sequence. Next, in content information estimation processing at S306, an estimator E(t_current, i, a(t_current)) corresponding to each component i and a measurement time t_current of the spectrum estimates content information of the component i. Next, in selection processing at S307, the aforementioned selection unit SEL(i, a) corresponding to each component i and each measurement operation a outputs the latest content information estimation result before t_current. Next, in estimation result presentation processing at S308, the estimation result presentation unit 204 presents a content information estimation result to a user. In this embodiment, the stop condition at S303 is not met, and an estimation result is presented at S308 during the execution of the loop from S303 to S308. Needless to say, an estimation result may be presented after the stop condition at S303 is met.

Figure 4:
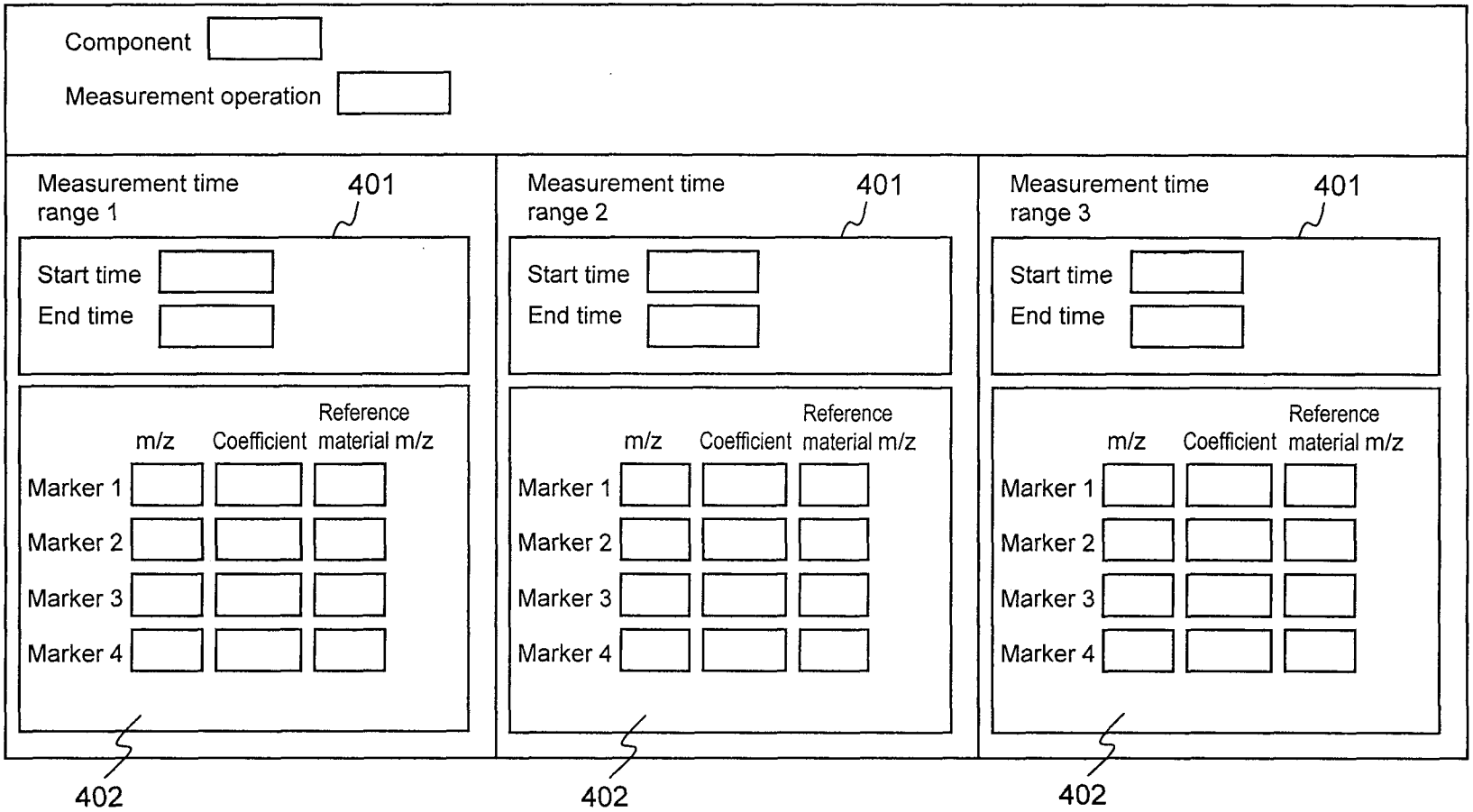
FIG. 4 is an exemplary graphical user interface of an estimation rule input/presentation unit of the present invention.

FIG. 4 is an exemplary graphical user interface of the estimation rule input/presentation unit 202 of the present embodiment. This example especially shows a graphical user interface enabling setting for concentration estimation. The estimation rule input/presentation unit 202 has a list box of components and measurement operations. The estimation rule input/presentation unit 202 further displays an estimation rule corresponding to a component and a measurement operation that a user selects from this list box and accepts an input to change the estimation rule.

The estimation rule input/presentation unit 202 has a measurement time setting panel 401 and an estimation rule setting panel 402 corresponding to each measurement time range, and therefore a user is allowed to set an estimation rule for each measurement time range. The measurement time setting panel has an input form for starting time and ending time of a measurement time range. The estimation rule setting panel has a plurality of forms called "markers", accepting m/z and input of a group of parameters associated with m/z. Information accepted by these forms may vary with the types of estimation rules. FIG. 4 shows an example where estimation is performed using m/z of a focused component, a coefficient to be multiplied to the intensity of the m/z and m/z of a reference material to normalize the intensity. The number of measurement time ranges and the number of markers are not limited to those illustrated in this drawing. As long as the storage area and the calculation resource permit, these numbers can be increased. Further, the input of detailed estimation rules such as an acceptable range of summation of intensities in the m/z axis direction may be accepted if needed. When a calibration curve is non-linear, high-order coefficients such as secondary and third-order coefficients may be accepted.

In this way, acceptance of an input of a different estimation rule for each measurement time, each component and each measurement operation allows an estimation rule leading to precise estimation of content information to be set even when a spectrum to be measured has a tendency of transitioning in intensity and shape with the passage of measurement time.

Further even when the spectrum to be measured has a tendency of transitioning in intensity and shape with the passage of measurement time, the estimation rule input/presentation unit 202 can present a different estimation rule for each measurement time, each component and each measurement operation enabling precise estimation of content information to a user in an easy-to-understand manner.

Figure 5:
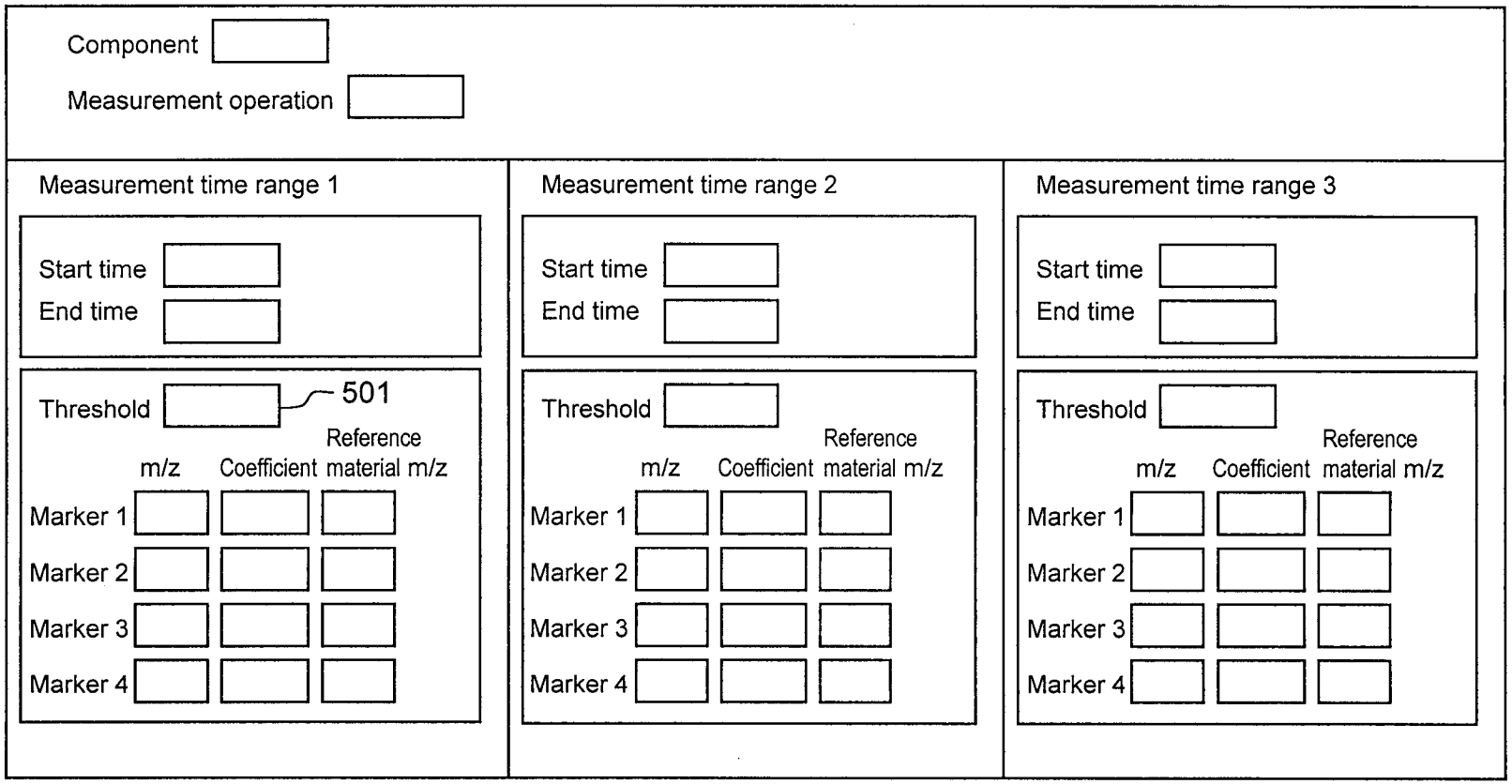
FIG. 5 is another exemplary graphical user interface of an estimation rule input/presentation unit of the present invention.

FIG. 5 is another exemplary graphical user interface of the estimation rule input/presentation unit 202 of the present embodiment. This example especially shows a graphical user interface enabling setting for existence determination. Compared with FIG. 4, the estimation rule setting panel has a threshold input form 501.

In this way, acceptance of an input of a different estimation rule for each measurement time, each component and each measurement operation allows an estimation rule leading to precise estimation of content information to be set even when a spectrum to be measured has a tendency of transitioning in intensity and shape with the passage of measurement time.

Further even when the spectrum to be measured has a tendency of transitioning in intensity and shape with the passage of measurement time, the estimation rule input/presentation unit 202 can present a different estimation rule for each measurement time, each component and each measurement operation enabling precise estimation of content information to a user in an easy-to-understand manner.

Figure 6:
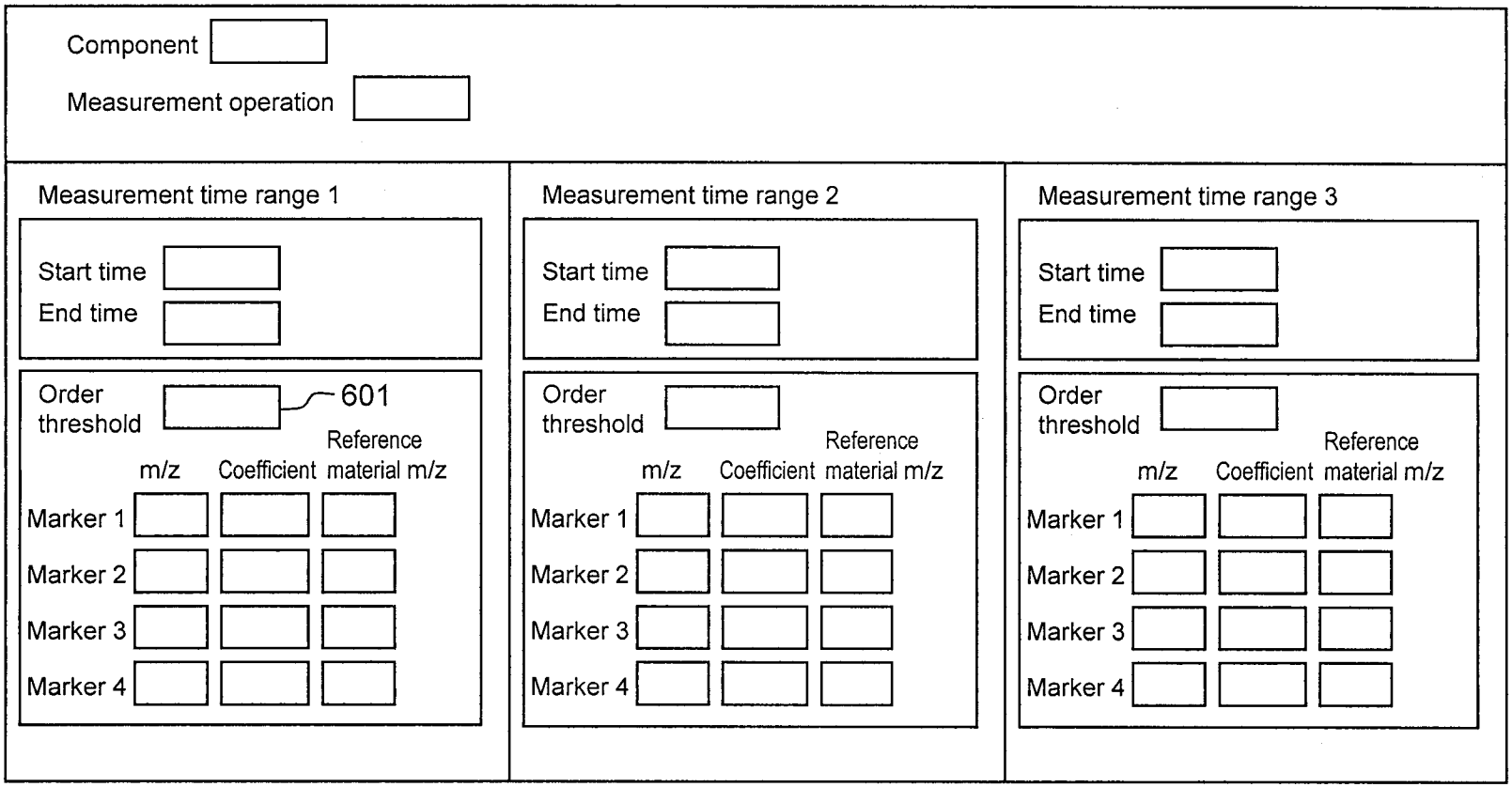
FIG. 6 is still another exemplary graphical user interface of an estimation rule input/presentation unit of the present invention.

FIG. 6 is still another exemplary graphical user interface of the estimation rule input/presentation unit 202 of the present embodiment. This example especially shows a graphical user interface enabling setting for existence determination based on the order of concentration. Compared with FIG. 4, the estimation rule setting panel has an input form 601 of "order threshold". The existence determination based on the order of concentration is a determination method determining as positive when the order of concentration of the component is within the order threshold TH_o among all components, and as negative otherwise. This determination method is based on a relative order relation of concentration among components, and therefore when it is known beforehand that the specimen actually contains only a small number of components in the list of all components, determination can be made precisely. For instance, when the spectrum of a specimen containing only one focused component at most has three peaks, two of them are more likely from impurity components if they are not fragment ions of the focused component. When each component is determined independently in a normal way, the component that is actually negative may be determined as positive due to the influences of these two impurity peaks. On the other hand, when determination is made based on the order of concentration, the component can be determined correctly as negative as long as the orders of the concentration of the two components that may be determined as positive due to these two impurity peaks are the second or lower.

In this way, acceptance of an input of a different estimation rule for each measurement time, each component and each measurement operation allows an estimation rule leading to precise estimation of content information to be set even when a spectrum to be measured has a tendency of transitioning in intensity and shape with the passage of measurement time.

Further even when the spectrum to be measured has a tendency of transitioning in intensity and shape with the passage of measurement time, the estimation rule input/presentation unit 202 can present a different estimation rule for each measurement time, each component and each measurement operation enabling precise estimation of content information to a user in an easy-to-understand manner.

FIG. 7 shows a data structure of the estimation rule database 203 of the present embodiment. This drawing especially shows an estimation rule for concentration estimation. Records 701 to 703 of the estimation rule are stored, each corresponding to a group of a measurement time, a component and a measurement operation. Similarly to the above, in this example also, m/z of a focused component, a coefficient to be multiplied to the intensity of the m/z and m/z of a reference material to normalize the intensity are used as parameters of the estimation rule, and a record of each estimation rule stores these parameters.

FIG. 8 shows a data structure 801 of the estimation rule database 203 of the present embodiment. This drawing especially shows an estimation rule for existence determination. A record of the estimation rule and a threshold are stored, corresponding to each group of a measurement time, a component and a measurement operation. Similarly to the above, in this example also, m/z of a focused component, a coefficient to be multiplied to the intensity of the m/z and m/z of a reference material to normalize the intensity are used as parameters of the estimation rule, and a record of each estimation rule stores these parameters.

FIG. 9 shows a data structure of the estimation rule database 203 of the present embodiment. This drawing especially shows an estimation rule for existence determination based on the order of concentration. A record of the estimation rule and an order threshold are stored, corresponding to each group of a measurement time, a component and a measurement operation. Similarly to the above, in this example also, m/z of a focused component, a coefficient to be multiplied to the intensity of the m/z and m/z of a reference material to normalize the intensity are used as parameters of the estimation rule, and a record of each estimation rule stores these parameters.

FIGS. 7 to 9 all illustrate an example where the types of content information to be estimated are the same for all of the records, where the content information is only one of the concentration of a component, the existence or not in the specimen or whether the concentration is within a certain order or not. However, this is not a limiting example, and the types of content information to be estimated may be changed depending on the component. Setting can be changed among the concentration estimation, the existence determination or the existence determination based on the concentration order depending on the measurement time, the component and the measurement operation.

Figure 10:
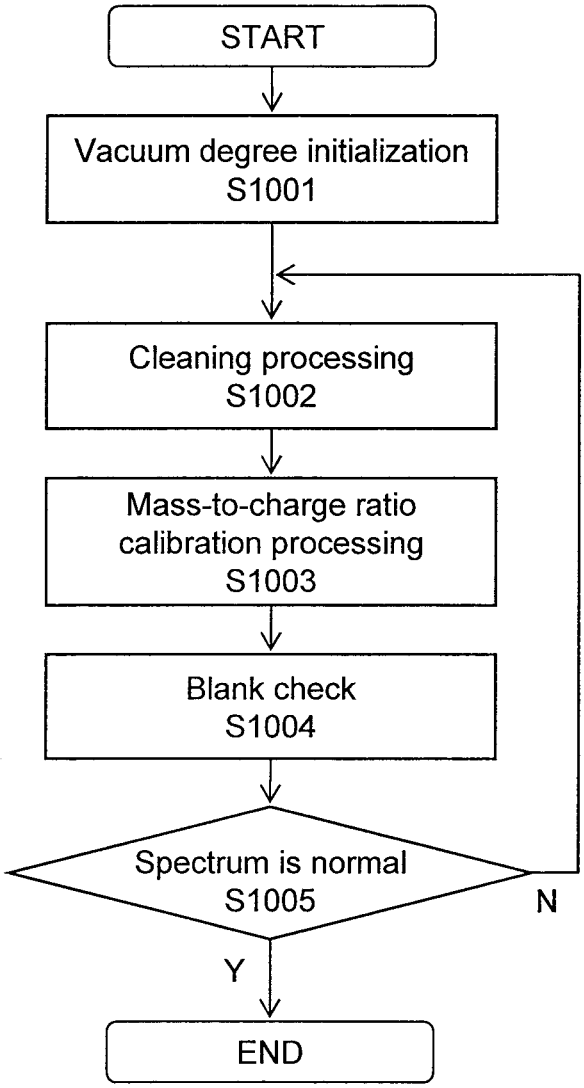
FIG. 10 is an exemplary flowchart of mass spectrometric unit initialization processing of the present invention.

FIG. 10 is a flowchart of the mass spectrometric unit initialization processing at S302 of the present embodiment.

Firstly at S1001 for vacuum degree initialization, the vacuum pumps 112 to 114 exhaust air until the pressure of chambers connected is reduced to an appropriate pressure, and keep the pressure. Next, at S1002 for cleaning processing, a user is requested to introduce a specimen such as ammonia, and when the specimen is introduced, the measurement thereof is executed. Thereby, a substance (carry over) adhered during the measurement last time is cleaned. Next, at S1003 for mass-to-charge ratio calibration processing, a user is requested to introduce a reference material specimen having a peak at known m/z, and when the specimen is introduced, the measurement thereof is executed. Based on the position of the peak of the measured spectrum, a correspondence table of element numbers on the array of mass spectrum and m/z is created.

Next, at S1004 for blank check, a user is requested to introduce a known specimen that does not contain a measurement target component, and when the specimen is introduced, the measurement thereof is executed. When the obtained spectrum meets a predetermined condition, it is determined at S1005 that the spectrum is normal, and the procedure ends. When it does not meet the condition, it is determined at S1005 that the spectrum is abnormal, and the procedure returns to the cleaning processing S1002. For example, when the obtained spectrum does not include a large peak, the spectrum may be determined as normal. As another example, the obtained spectrum is considered as a M-dimensional vector, and when a cosine similarity to a reference spectrum measured in the past is higher than a certain threshold, the spectrum may be determined as normal. In this way, the determination for normality may be made using an appropriate known method.

Figure 11:
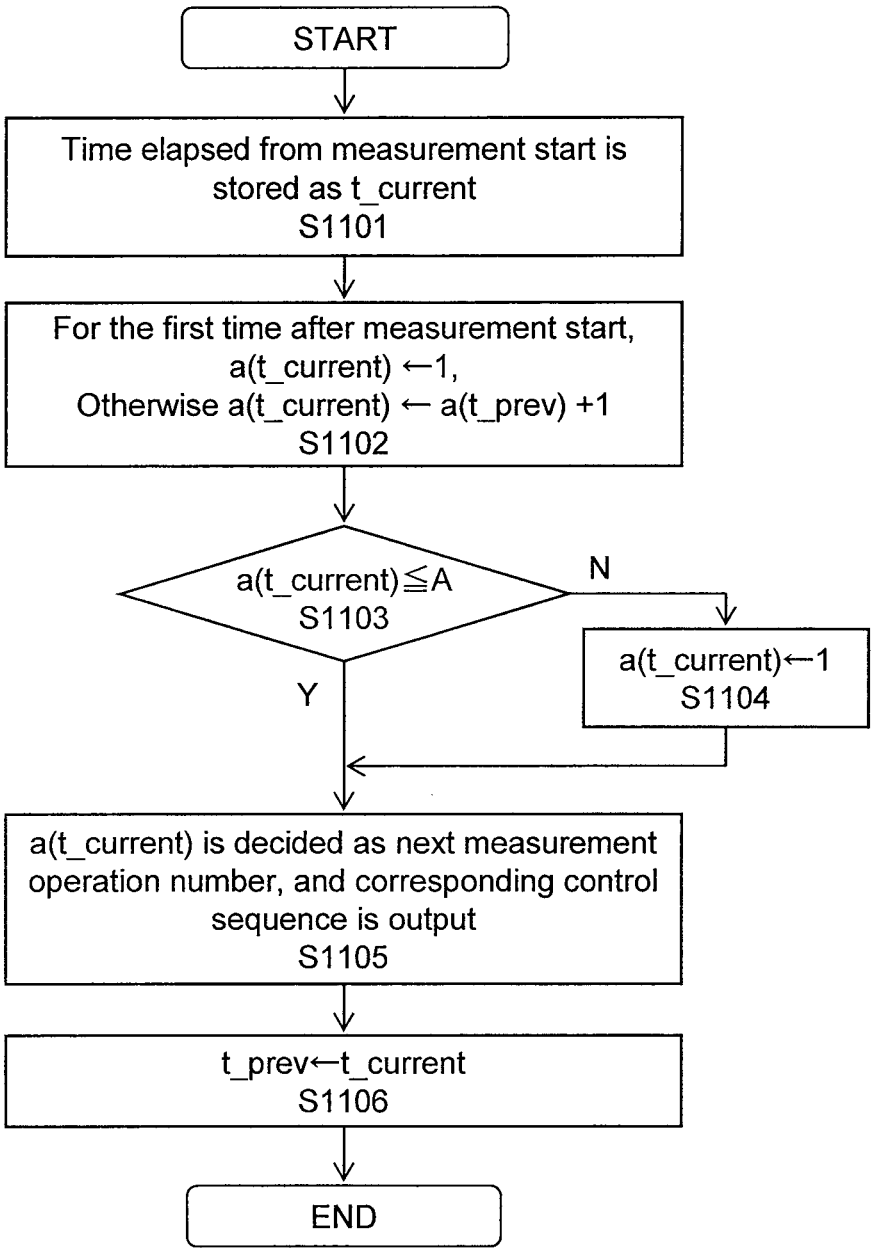
FIG. 11 is an exemplary flowchart of measurement operation decision processing of the present invention.

FIG. 11 is a flowchart of the measurement operation decision processing at S304 of the present embodiment. In the present embodiment, a measurement operation is executed in a fixed order.

Firstly at S1101, a time elapsed from the measurement start is stored as t_current indicating the current measurement time. At S1102, when the operation is performed for the first time after the measurement start, a measurement number 1 is stored for the next performing measurement operation a(t_current), and otherwise the value obtained by adding 1 to the measurement number a(t_prev) of the previous measurement operation is stored for the next performing measurement operation a(t_current). At S1003, when a(t_current) is A or less, the procedure directly proceeds to S1105, and otherwise at S1104 a measurement number 1 is stored as a(t_current), and the procedure proceeds to S1105. At S1105, a(t_current) is decided as the next measurement operation number, and a control sequence corresponding to this measurement operation number is generated and output.

Figure 12:
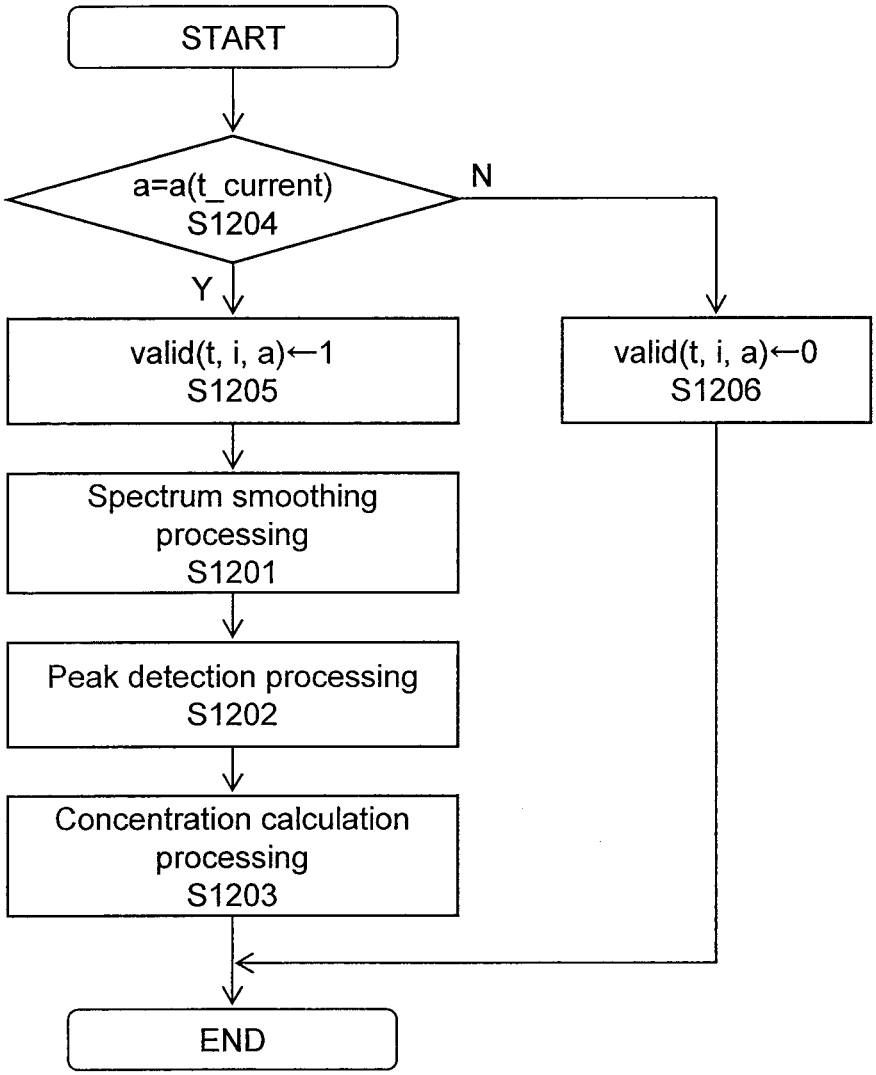
FIG. 12 is an exemplary flowchart of content information estimation processing of the present invention.

FIG. 12 is a flowchart of the content information estimation processing at S306 of the present embodiment. This flowchart especially shows the case for concentration estimation. At the measurement time t_current, an estimator E(t_current, i, a) executes the following processing for each component i and each measurement operation a.

Firstly at S1204, determination is made whether the current measurement operation a(t_current) is the same as the measurement operation a of the estimator E(t_current, i, a). When it is the same, at S1205, 1 is stored as valid flag valid(t, i, a), and the procedure proceeds to S1201. Otherwise, the procedure proceeds to S1206, where 0 is stored as the valid(t, i, a) and the procedure ends.

Next, at S1201, smoothing is performed for a mass spectrum X=(x_1, . . . , x_M) including high-frequency noise superimposed thereon, whereby a smoothed spectrum X'=(x_1, . . . , x_M) with reduced high-frequency noise is calculated. The smoothing may be performed using a known appropriate method such as a moving-average method, Gaussian filter convolution or a FFT filter. At peak detection processing S1202, peak detection processing is performed to extract a peak of each component. The peak detection method may be a known appropriate one. For instance, the magnitude y_c of a peak is calculated by Expression (1) for all element numbers m=1, . . . , M of X', and when y_c is a threshold TH_Y, it is detected as a peak. The position m_c of a m/z of the peak is calculated by Expression (2).

$$y_c = \sum_{m'=m-TH_W}^{m+TH_W} x_m \tag{1}$$

$$m_c = \frac{\sum_{m'=m-TH_W}^{m+TH_W} m' x_m}{\sum_{m'=m-TH_W}^{m+TH_W} x_m} \tag{2}$$

When the m/z parameter m_j has a distance from m_c of a threshold TH_X or lower for all of L pieces of makers j set as the estimation rule, y_c is stored at the intensity I_j of the marker j. When this peak detection processing is completed for all elements of X', 0 is stored as the intensity I_j of the marker j where distances from all peaks are not the threshold TH_X or lower. At S1203, concentration calculation processing is performed, and estimated concentration d(t, i, a) is output. The value of d(t, i, a) may be calculated using Expression (3), for example. Herein, g_1, . . . , g_L are marker coefficients set as the estimation rule, r_1, . . . , r_L are m/z of a reference material set as the estimation rule, and I_r_1, . . . , I_r_L are intensity of m/z of the reference material.

$$d(t, i, a) = \sum_{j=1}^{L} g_j \times \frac{I_j}{I_r_j} \tag{3}$$

Since the content information estimation processing of the present embodiment uses an appropriate estimation rule for each measurement time, component and measurement operation, even when the spectrum to be measured has a tendency of transitioning in intensity and shape with the passage of measurement time, content information can be estimated precisely.

Figure 13:
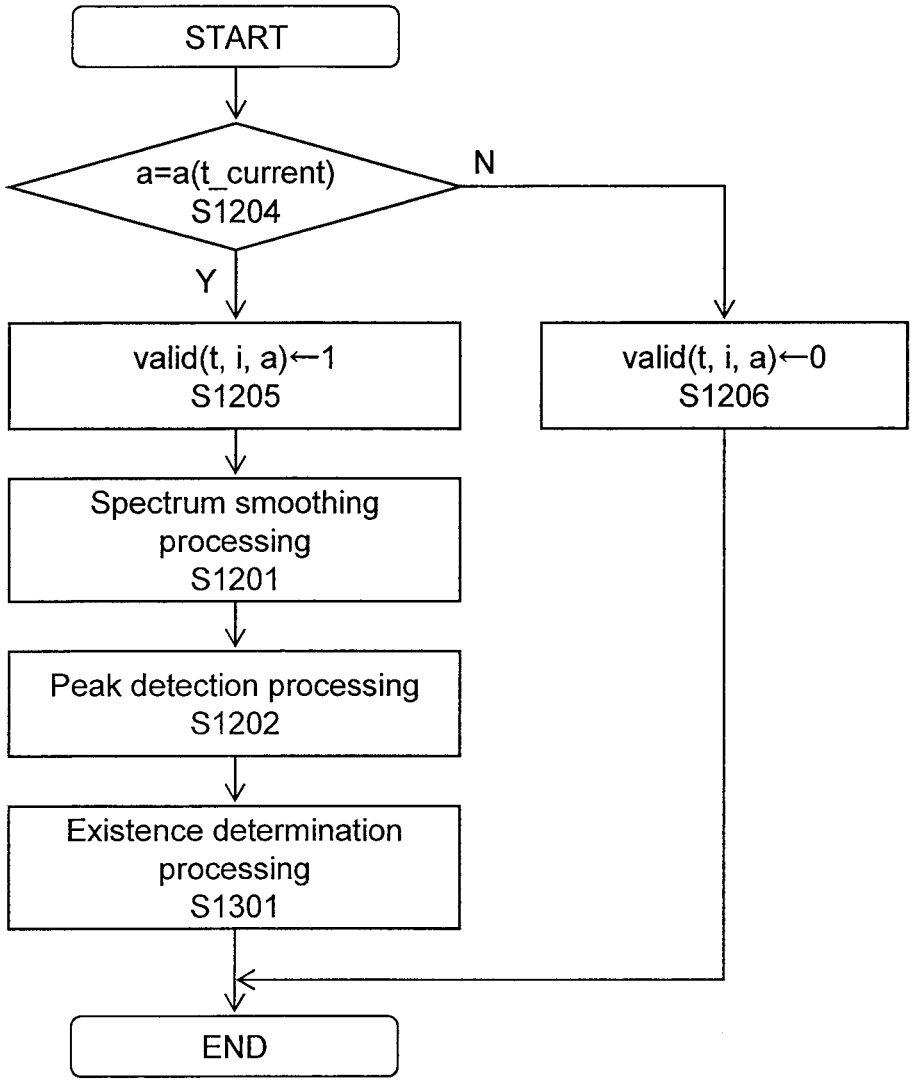
FIG. 13 is another exemplary flowchart of content information estimation processing of the present invention.

FIG. 13 is a flowchart of the content information estimation processing at S306 of the present embodiment. This flowchart especially shows a flowchart for existence determination. At the measurement time t_current, an estimator E(t_current, i, a) executes the following processing for each component i and each measurement operation a. Branching based on the determination result at S1204, assignment processing at S1205 and S1206, the spectrum smoothing processing at S1201 and the peak detection processing at S1202 each are the same processing as those illustrated in FIG. 12 for concentration estimation.

In existence determination processing at S1301, a label value res(t, a)={positive, negative} as an existence determination result is output. The res(t, i, a) may be calculated using Expression (4), for example. Herein, TH(t, i, a) is a threshold set as the estimation rule.

$$res(t, i, a) = \begin{cases} \text{Positive} & \text{if } \sum_{j=1}^{L} g_j \times \frac{I_j}{I_r_j} > TH(t, i, a) \\ \text{Negative} & \text{otherwise.} \end{cases} \tag{4}$$

Since the content information estimation processing of the present embodiment uses an appropriate estimation rule for each measurement time, component and measurement operation, even when the spectrum to be measured has a tendency of transitioning in intensity and shape with the passage of measurement time, content information can be estimated precisely.

Figures 14, 15:
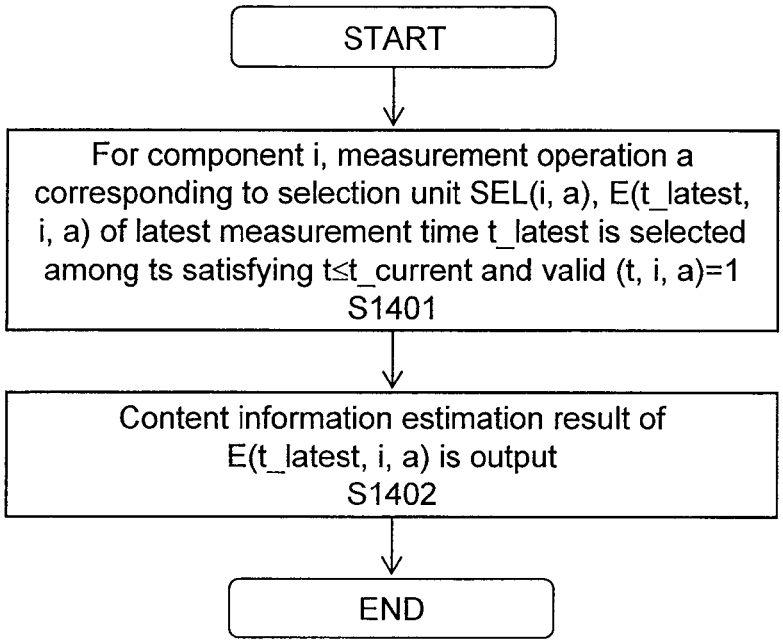
FIG. 14 is an exemplary flowchart of selection processing of the present invention.
FIG. 15 is an exemplary graphical user interface of an estimation result presentation unit of the present invention.

FIG. 14 is a flowchart of the selection processing at S307 of the present embodiment. At measurement time t_current, a selection unit SEL(i, a) executes the following processing for each component i and each measurement operation a. Firstly, at S1401, for the component i, and each measurement operation a, a latest measurement time t_latest is selected from is satisfying t_current and valid (t, i, a)=1. Then at S1402, a content information estimation result of E(t_latest, i, a) and res(t_latest, i, a) in the case of existence determination or d(t_latest, i, a) in the case of concentration estimation are output.

FIG. 15 is a graphical user interface of the estimation result presentation unit 204 of the present embodiment. This drawing especially shows the case of concentration estimation. The estimation result presentation unit 204 displays the latest result d_i of a concentration estimation value of each component. Herein, d_i is the output d(i, a') corresponding to a measurement operation a=a' measured at the measurement time t having valid(t, i, a)=1 that is the closest to t_current among d(i, a) that the selection unit SEL(i, a) outputs for each component i and each measurement operation a. Component names 1501 and concentration estimation results 1502 are displayed in this example.

Figures 16, 17:
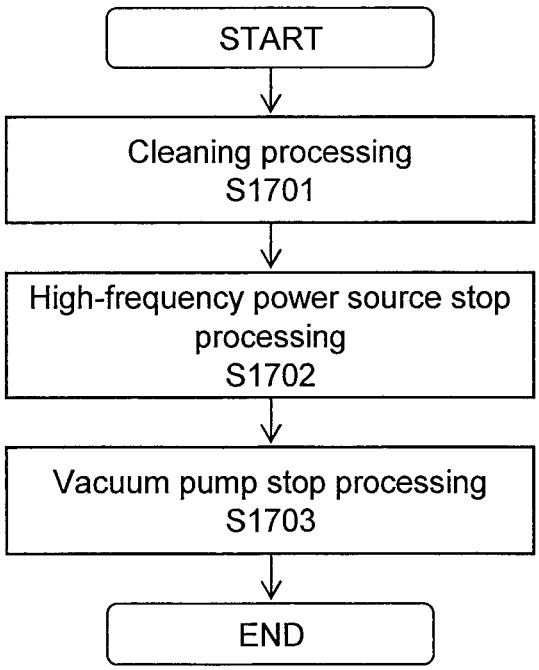
FIG. 16 is another exemplary graphical user interface of an estimation result presentation unit of the present invention.
FIG. 17 is an exemplary flowchart of a mass spectrometric unit end processing of the present invention.

FIG. 16 is a graphical user interface of the estimation result presentation unit 204 of the present embodiment. This drawing especially shows the case of existence determination. The estimation result presentation unit displays the latest result res_i of a label indicating whether each component is contained in the specimen or not. Herein, res_i is the output res(i, a') corresponding to a measurement operation a=a' measured at the measurement time t having valid(t, i, a)=1 that is the closest to t_current among res(i, a) that the selection unit SEL (i, a) outputs for each component i and each measurement operation a. Component names 1601 and existence determination results 1602 are displayed in this example.

FIG. 17 is a flowchart of the mass spectrometric unit end processing at S309 of the present embodiment. Cleaning processing at S1701 is the same processing as that of the cleaning processing at S1002. In high-frequency power source stop processing at S1702, the high-frequency power source 103 is stopped. After the completion of the high-frequency power source stop, the vacuum pumps 112 to 114 are stopped in vacuum pump stop processing at S1703.

According to the present embodiment, even when the spectrum to be measured has a tendency of transitioning in intensity and shape with the passage of measurement time, content information can be estimated precisely.

Embodiment 2

The present embodiment describes an exemplary mass spectrometric system capable of estimating content information precisely even when a spectrum varies in intensity and shape for each measurement time stochastically.

The intensity and the shape of a spectrum may vary stochastically for each measurement time due to factors such as fluctuations of voltage generated at an electric circuit of the mass spectrometric unit, fluctuations of timing when a control sequence is executed, fluctuations of devices during measurement, fluctuations of the accumulation amount of ions and fluctuations of ionization efficiency.

Figure 18:
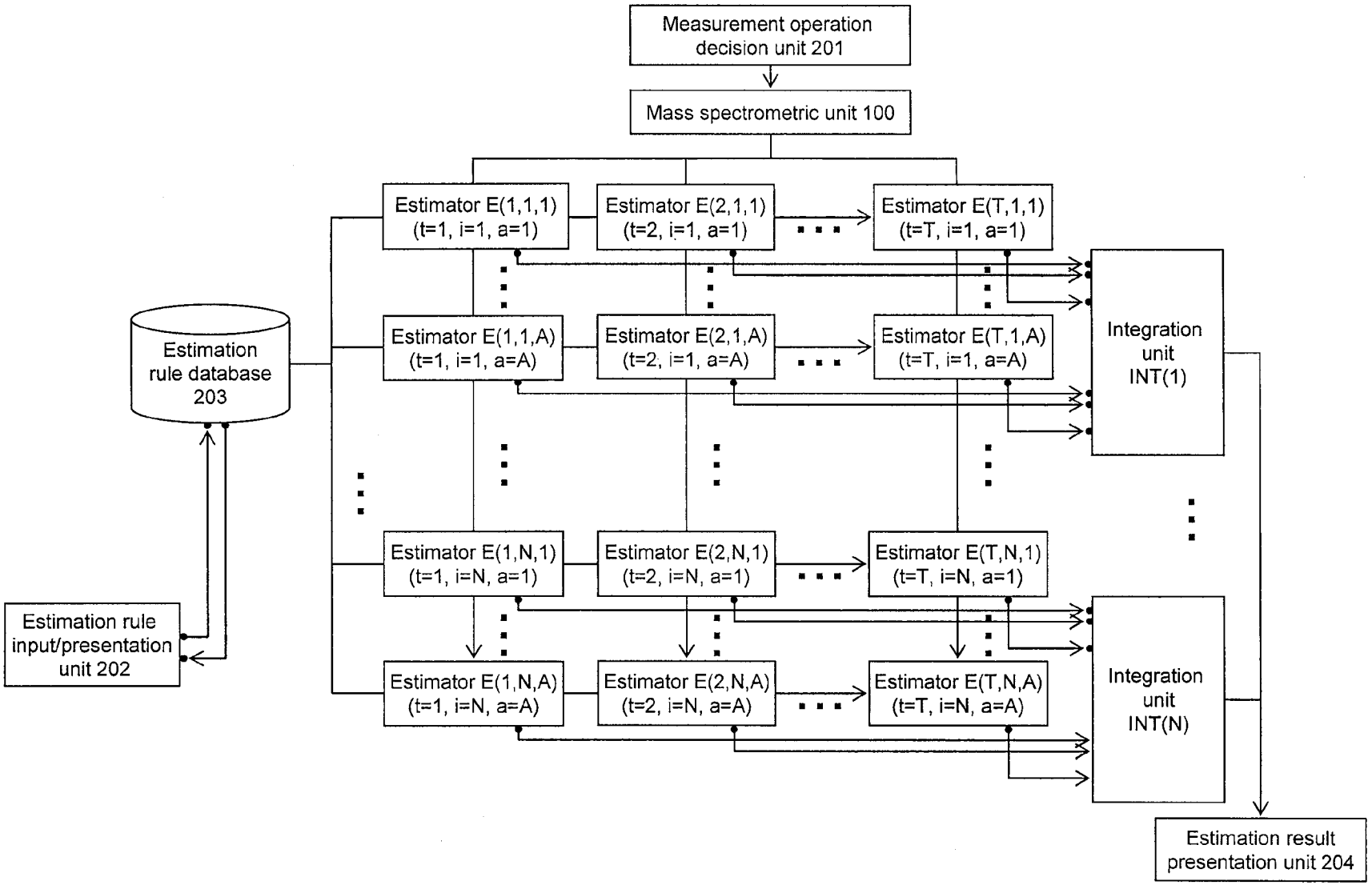
FIG. 18 shows an exemplary processing block configuration of a mass spectrometric system of the present invention.

FIG. 18 shows a processing block configuration of the mass spectrometric system 111 of the present embodiment. The configuration is different from Embodiment 1 in that an integration unit INT(i) exists for each component i instead of the selection unit.

The integration unit INT(i) integrates existence determination results res (t, i, a) or concentration estimation values d(t, i, a) output from all E(t, i, a) that have valid(t, i, a)=1 and are measured at the measurement time t before t_current, and outputs a content information estimation result res(i) or a concentration estimation value d(i) for the component i.

Figure 19:
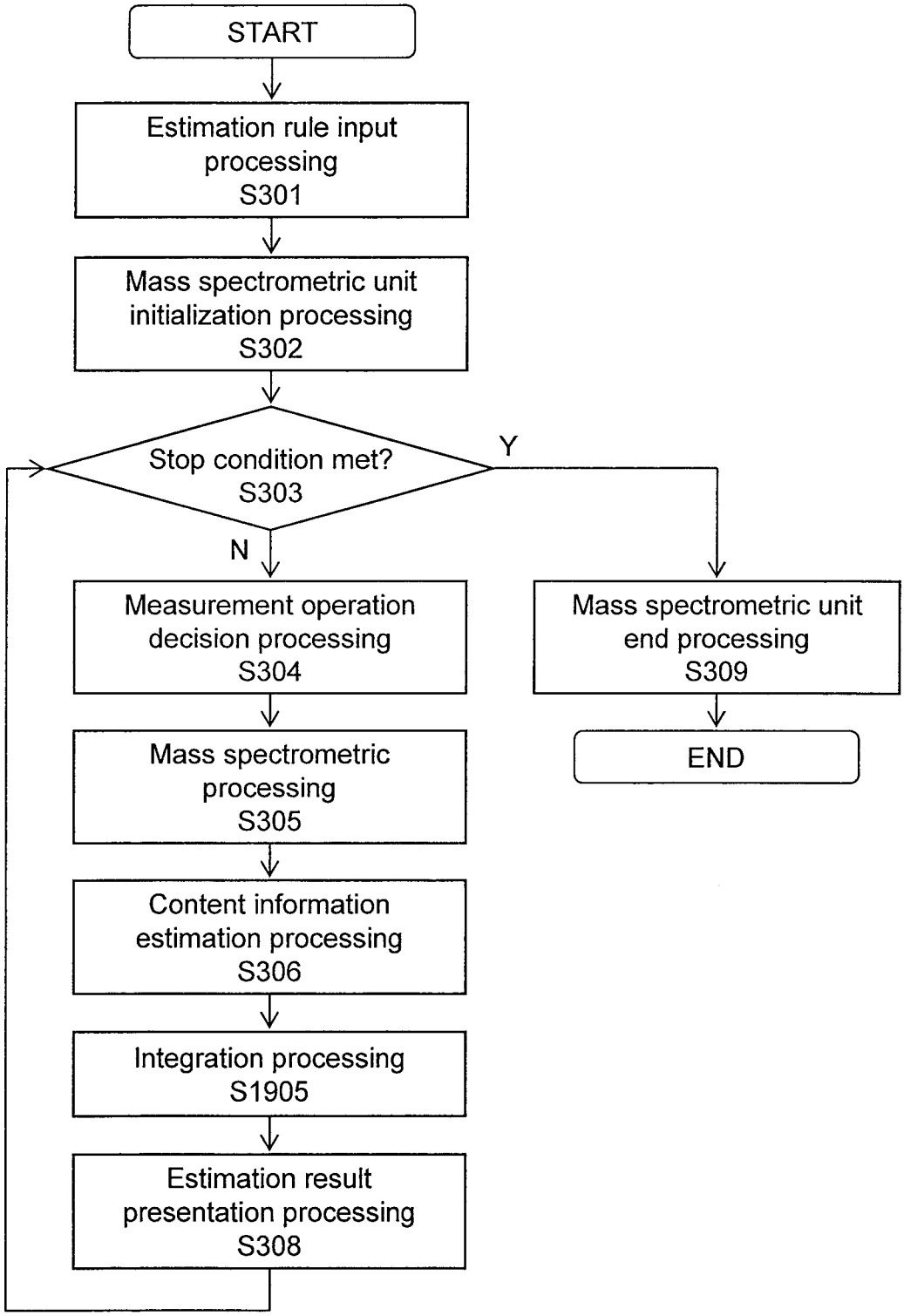
FIG. 19 is another exemplary flowchart of the operation of the mass spectrometric system of the present invention.

FIG. 19 is a flowchart of the operation of the mass spectrometric system 111 of the present embodiment. This operation is different from Embodiment 1 in that integration processing S1905 exists. At integration processing S1905, the aforementioned integration unit INT(i) corresponding to each component i integrates all of the content information estimation results at measurement times before t_current, and outputs the integrated content information estimation result. The following describes this operation in details, with reference of FIG. 20.

Figure 20:
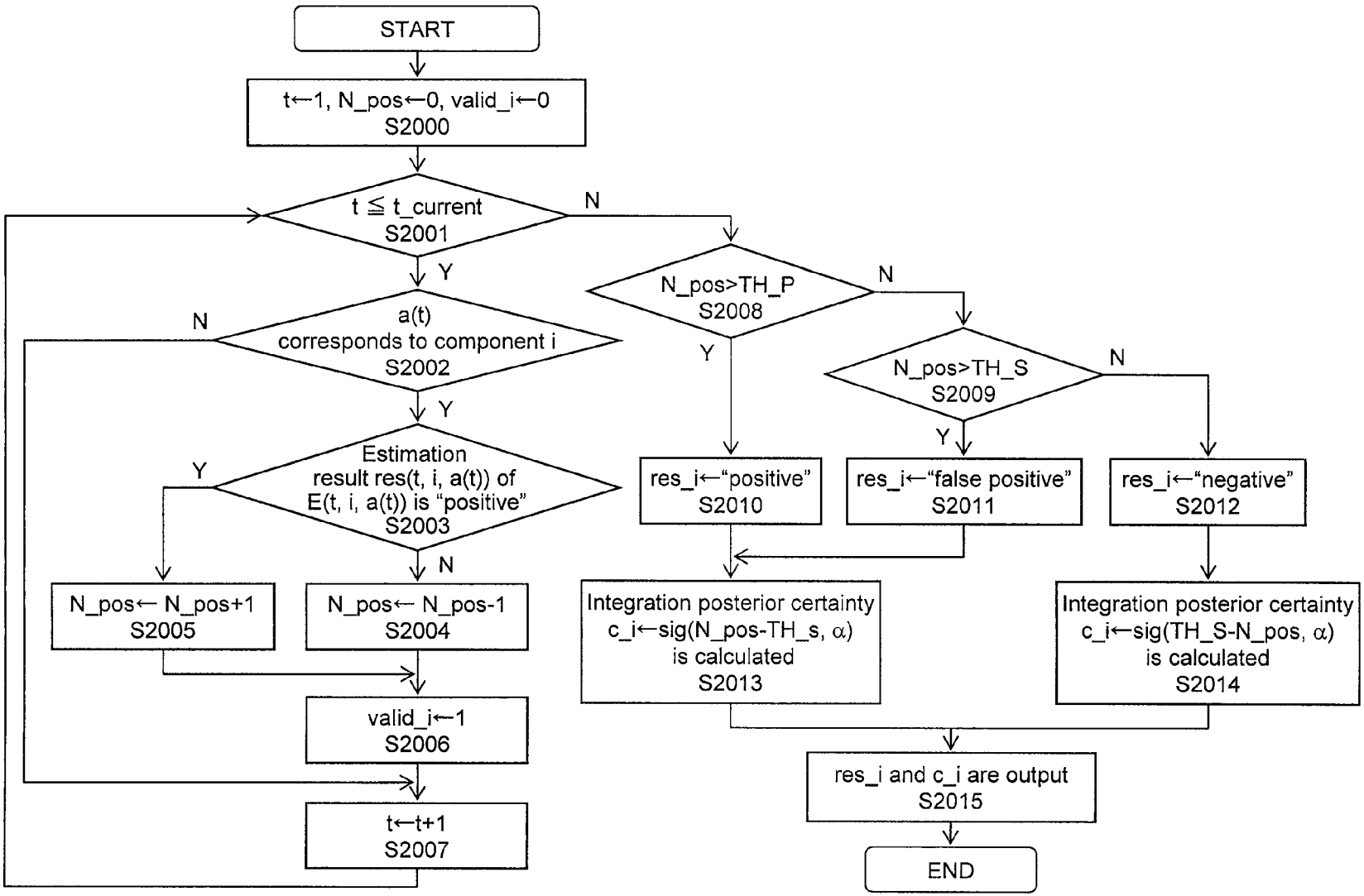
FIG. 20 is an exemplary flowchart of integration processing of the present invention.

FIG. 20 is a flowchart of the integration processing at S1905 of the present embodiment. This flowchart especially describes the case of existence determination.

Firstly, at S2000, initialization processing is performed. 1 is stored as a measurement time number t and 0 is assigned as valid flag valid_i. Next, when the measurement time number t is t_current or less at S2001, the procedure proceeds to S2002. Otherwise, the procedure proceeds to S2008. In the loop from S2001 to S2007, the processing corresponds to the calculation of a difference between the frequency of "positive" and the frequency of "negative" as the estimation results during the entire measurement time. At S2002, when a measurement operation a(t) at the measurement time t is a measurement operation targeting at the component i, the procedure proceeds to S2003. Otherwise, the procedure proceeds to S2007. At S2003, determination is made whether the estimation result res(t, i, a) of the E(t, i, a(t)) is "positive" or not, and when it is "positive", 1 is added to N_pos at S2005, and the procedure proceeds to S2006. Otherwise, 1 is subtracted from N_pos at S2004, and the procedure proceeds to S2006. At S2006, 1 is stored as valid_i. At S2007, 1 is added to t and the procedure returns to S2001.

At S2008, when N_pos is larger than a threshold TH_P, "positive" is stored as the content information estimation result res_i at S2010, and the procedure proceeds to S2013. Otherwise, determination is made whether N_pos is larger than the threshold TH_S at S2009, and when it is larger, "false positive" is stored as the content information estimation result res_i at S2011, and the procedure proceeds to S2013. Otherwise, "negative" is stored as res_i at S2012, and the procedure proceeds to S2014.

At S2013, integration posterior certainty c_i=sig(N_pos−TH_s, $\alpha$) is calculated. Herein, sig(z, $\alpha$) is calculated using Expression (5). At S2014, integration posterior certainty c_i=sig(TH_S−N_pos, $\alpha$) is calculated. Herein, $\alpha$ is an appropriate positive constant. As this integration posterior certainty c_i is higher, the probability that integrated content information estimation result is correct becomes higher. Next, at S1205, res_i and c_i are output and the procedure ends.

$$sig(z, \alpha) = \frac{1}{1 + e^{-\alpha z}} \quad (5)$$

In this way, integration of the estimation results of measurement times enables cancellation of influences by fluctuations of the estimation results of the measurement times, thus increasing the probability that integrated content information estimation result is correct. Further, the frequencies of the estimation results of the measurement times are counted, and so there is no need to continuously execute the measurement operation over the entire measurement time t. Even when the estimation result is lost for some measurement times as in valid (t, i, a(t))=0 and the measurement operation corresponding to each component i is executed intermittently, estimation is enabled, and even when the measurement operation is executed at irregular intervals, estimation is enabled. Therefore, estimation is enabled when the measurement operation decision unit 201 executes not only in a fixed order but also in an appropriate variable order.

The above example describes the case where content information estimation results of all measurement times after the measurement start are integrated. Needless to say, instead of using the content information estimation results for all of the measurement times, a part thereof may be used. Content information estimation results only during a measurement time section set beforehand only may be integrated, or content information estimation results during a measurement time section close to the current measurement time may be integrated.

Figure 21:
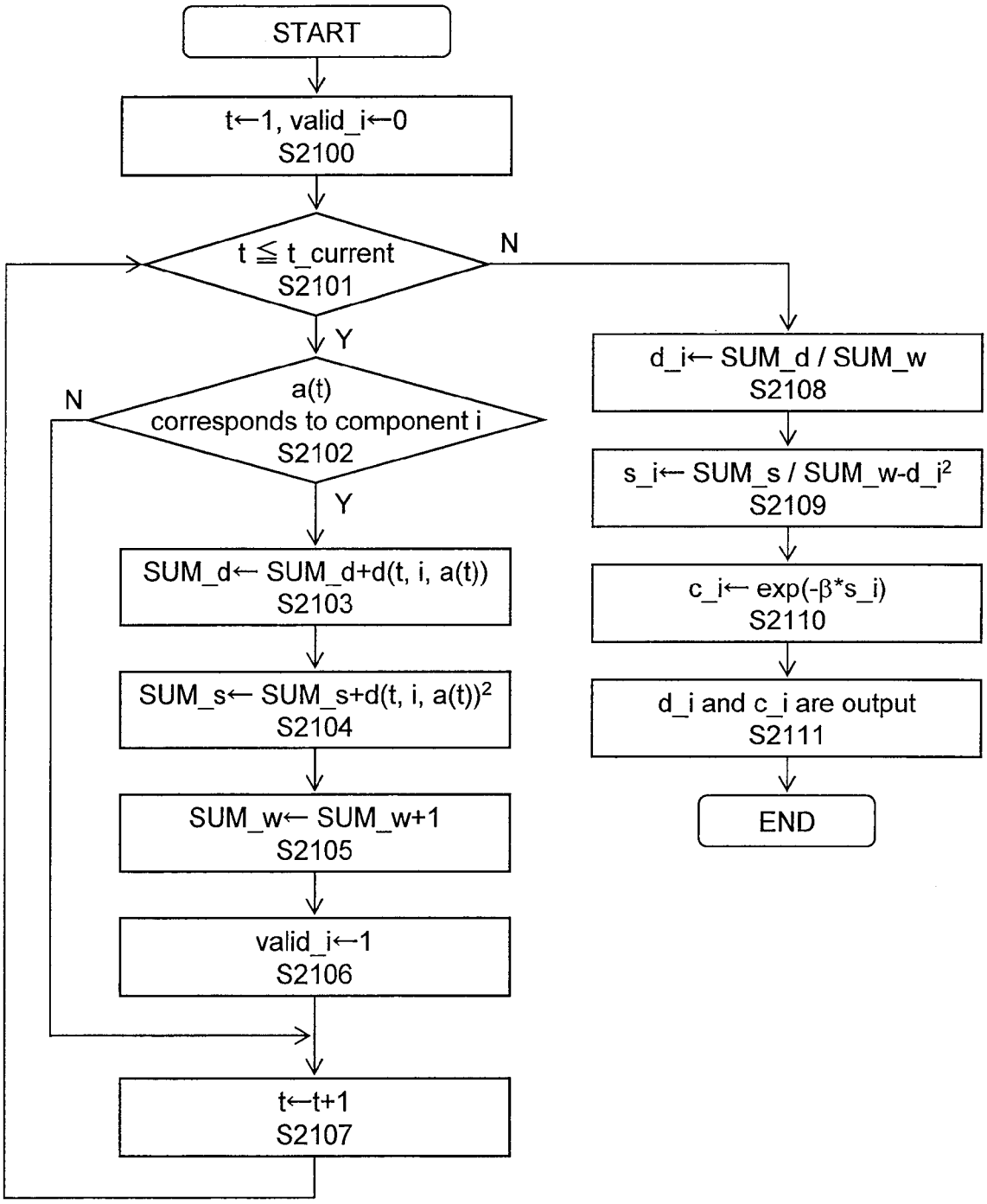
FIG. 21 is another exemplary flowchart of integration processing of the present invention.

FIG. 21 is a flowchart of the integration processing S1905. This drawing especially shows the flowchart for concentration estimation.

Similarly to the case of existence determination of FIG. 20, in the loop from S2101 to S2107, the results over the entire measurement time are integrated. At S2103, d(t, a(t)) is added to the total sum SUM_d of the concentration estimation values, at S2104, the square of d(t, i, a(t)) is added to the total sum SUM_s of the square of the concentration estimation values and at S2105, 1 is added to the total SUM_w of the frequency of addition.

After the completion of the loop for each measurement time, at S2108, d_i=SUM_d/SUM/w is calculated as the average value of the concentration estimation values. At S2109, s_i=SUM_s/SUM_w−d_i$^2$ is calculated as the variance of the concentration estimation values. At S2110, integration posterior certainty c_i=exp(−β(s_i)) is found. Herein, β is an appropriate positive constant. As this integration posterior certainty c_i is higher, the variation of the content information estimation results of measurement times becomes less, which means that probability that integrated content information estimation result is correct becomes higher.

Although this example describes the estimation method by averaging, the estimation may be performed by geometric average, harmonic average, or estimation based on a median. An appropriate known estimation method may be used.

According to the present embodiment, content information can be estimated precisely even when a spectrum varies in intensity and shape for each measurement time stochastically.

FIG. 22 shows a graphical user interface of the estimation result presentation unit 204 of the present embodiment. This example especially shows the case of existence determination. In this way, integration posterior certainty 2203 displayed together with component names 2201 and existence determination results 2202 allows a user to know the probability that the content information estimation result is correct. Integration posterior certainty may be displayed similarly also in the case of concentration estimation.

According to the present embodiment, content information can be estimated precisely even when a spectrum varies in intensity and shape for each measurement time stochastically.

Embodiment 3

The present embodiment describes an exemplary mass spectrometric system capable of estimating content information precisely even when the precision of a content information estimation result at each measurement time tends to transition with the passage of the measurement time.

When the precision of a content information estimation result at each measurement time tends to transition with the passage of the measurement time, an estimation result at a time when a result with relatively low-degree of precision is obtained adversely affects the precision of the integrated content information estimation result. In order to avoid this, in the present embodiment, processing is performed so as to emphasize an estimation result at a time when a result with high-degree of precision can be obtained, whereby the precision of the integrated content information estimation result is improved.

Figure 23:
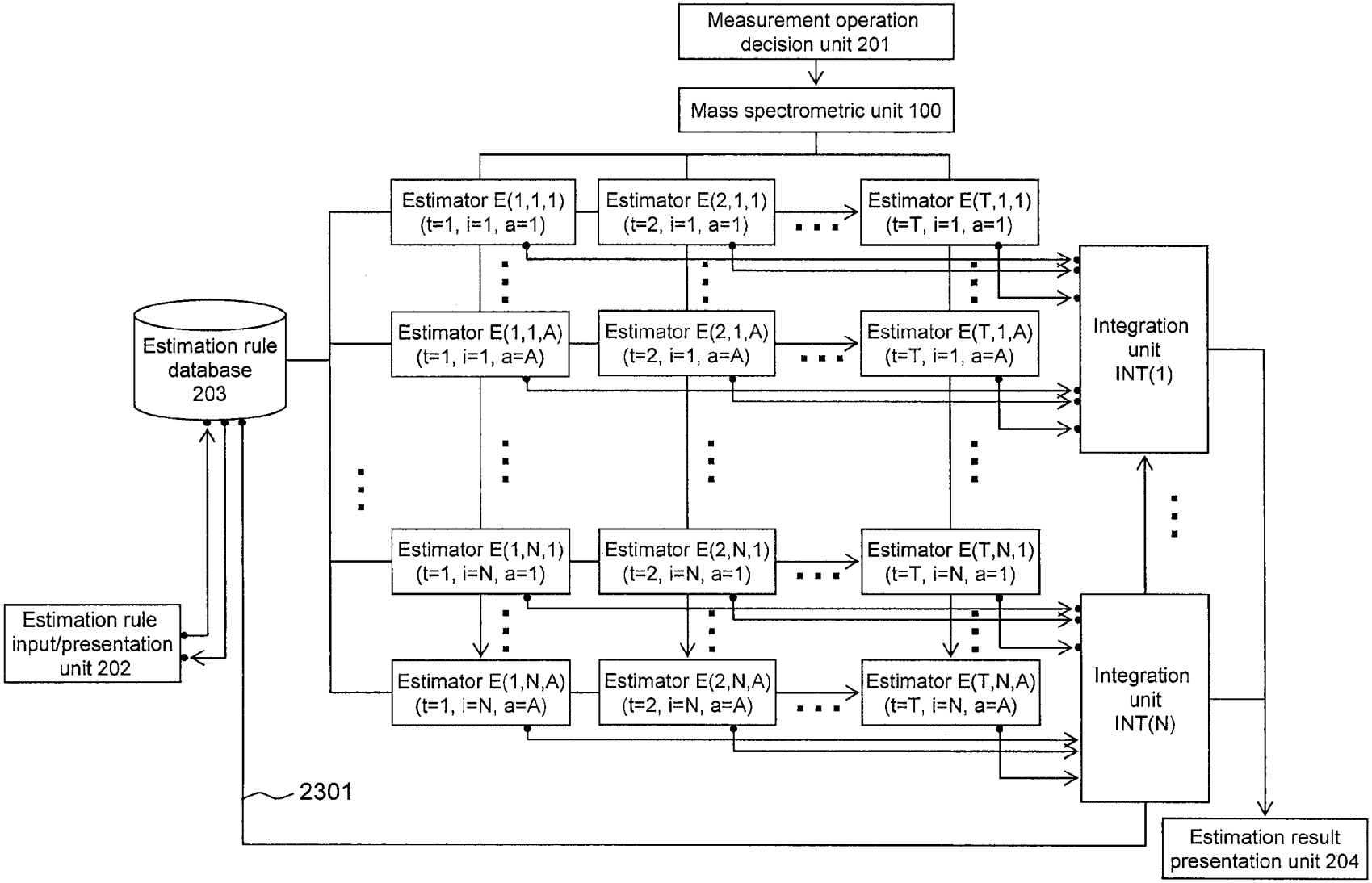
FIG. 23 shows another exemplary processing block configuration of a mass spectrometric system of the present invention.

FIG. 23 shows a processing block configuration of the mass spectrometric system 111 of the present embodiment. The configuration is different from Embodiment 2 in that certainty weight 2301 for each measurement time, each component and each measurement operation on the estimation rule database is input to an integration unit INT(i) corresponding to each component i, and the integration unit INT(i) executes integration using the certainty weight 2301. The present embodiment follows the same flowchart FIG. 19 as in Embodiment 2.

Figure 24:
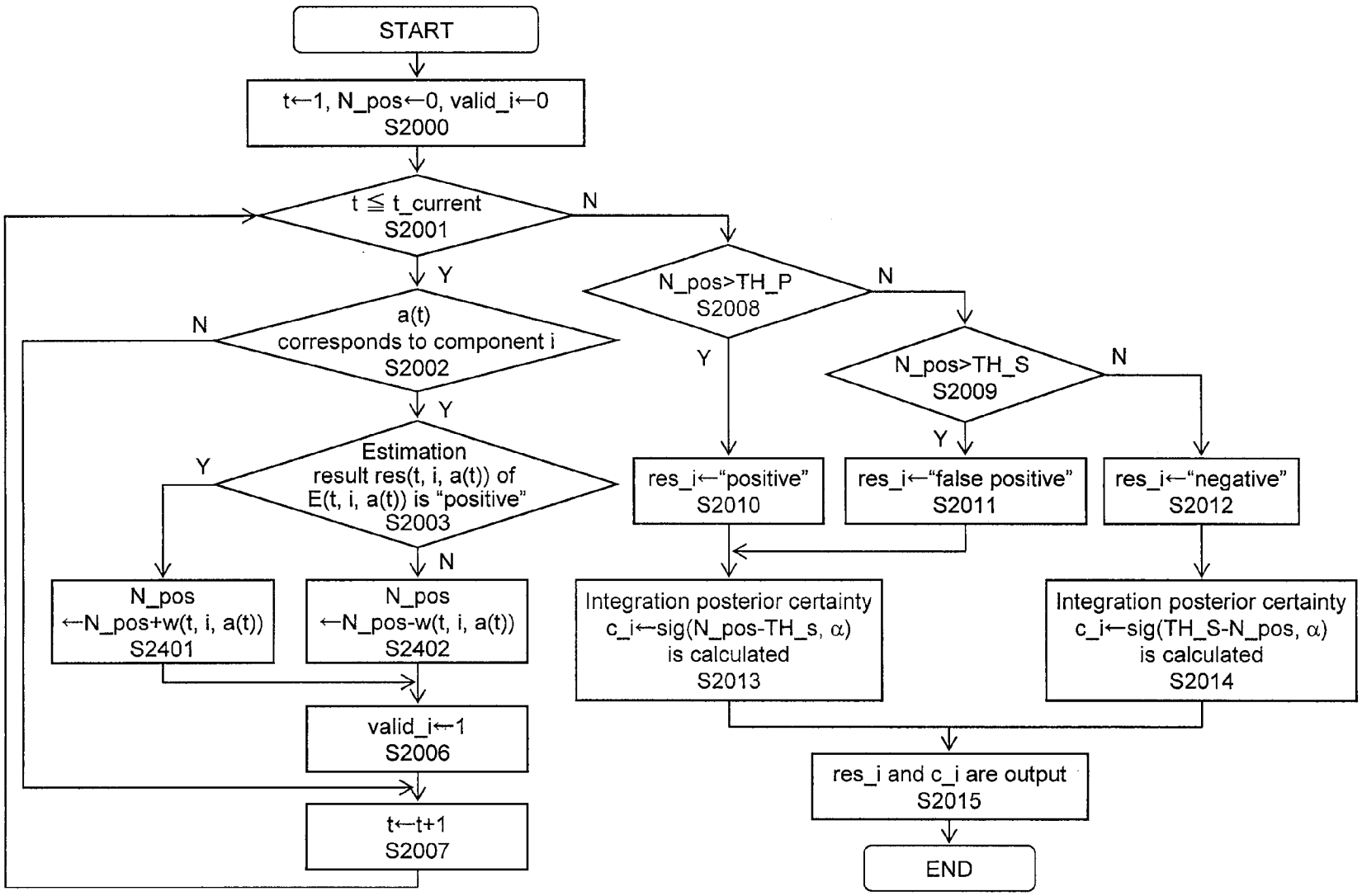
FIG. 24 is another exemplary flowchart of integration processing of the present invention.

FIG. 24 is a flowchart of the integration processing at S1905 of the present embodiment. This flowchart especially describes the case of existence determination. This flowchart is different from FIG. 20 of Embodiment 2 in that certainty weight w(t, i, a(t)) is added to N_pos at S2401 and the certainty weight w(t, i, a(t)) is subtracted from N_pos at S2402. Thereby, an estimation result using a spectrum at a measurement time and of a measurement operation with high certainty weight w(t, i, a(t)) will be emphasized.

When certainty weight is not set for the component i, estimation is enabled using certainty weight w(t, a(t)) of a component i' having similar volatility. This case leads to an advantage of avoiding a user's necessity of inputting a parameter for all components.

Figure 25:
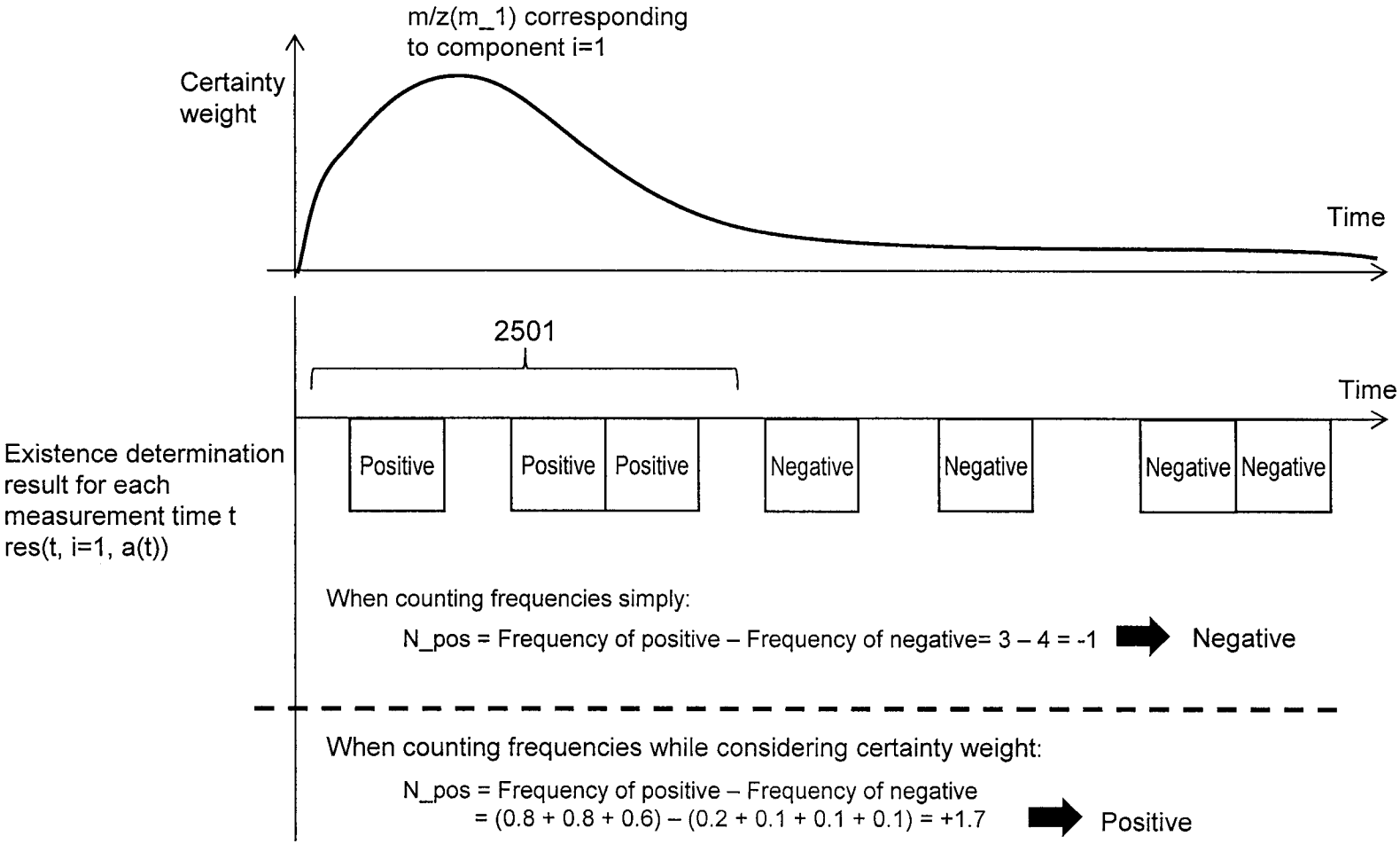
FIG. 25 schematically shows the effect from the integration processing of the present invention.

FIG. 25 schematically shows the effect from the integration processing at S1905 of the present embodiment. When the frequency is simply counted as in Embodiment 2, N_pos becomes −1, and so res(i) will be "negative". On the other hand, in the present embodiment, since certainty weight is counted, a result of a time zone 2501 with high-degree of precision is emphasized, whereby it can be determined as "positive".

Figure 26:
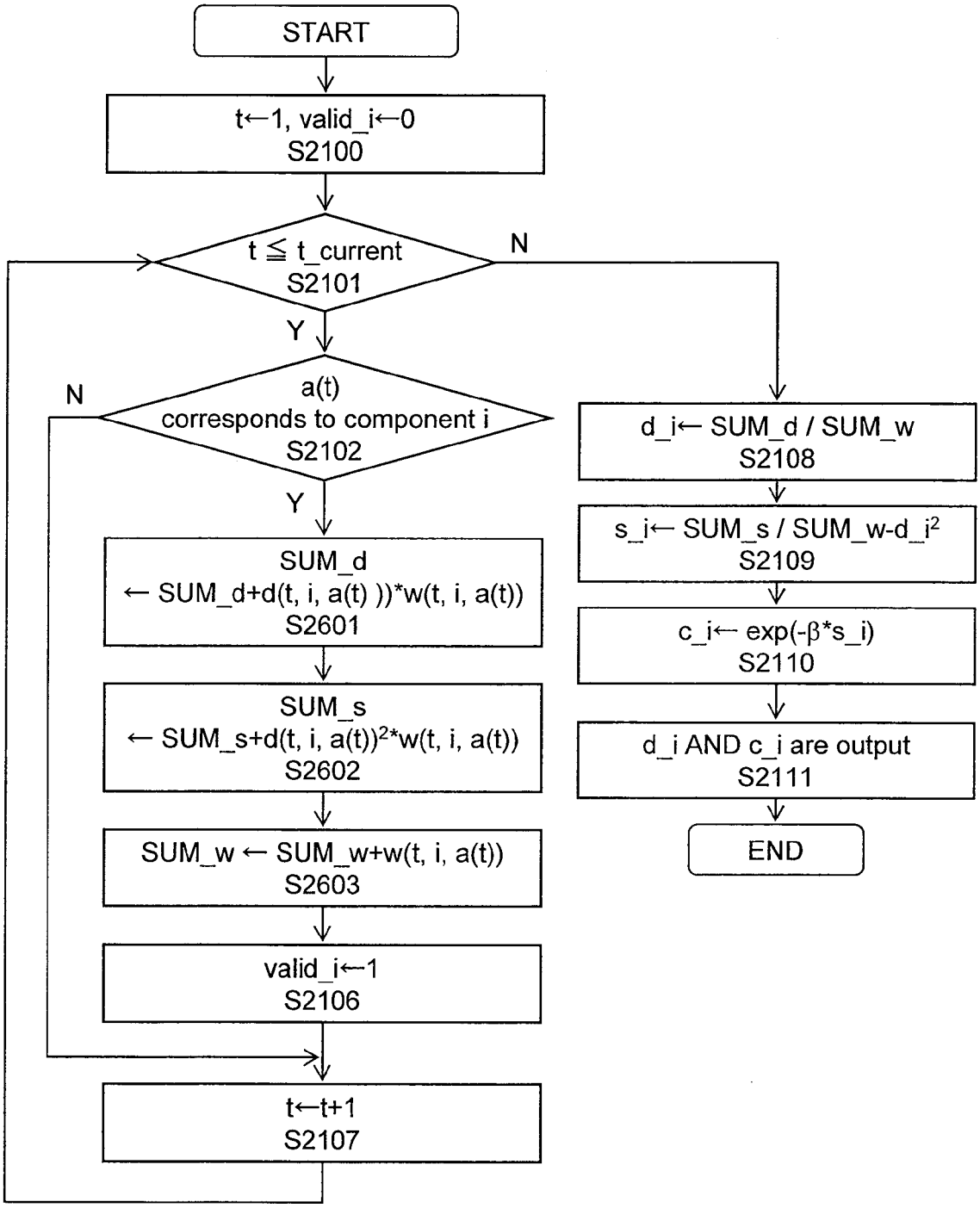
FIG. 26 is an exemplary flowchart of integration processing of the present invention.

FIG. 26 is a flowchart of the integration processing at S1905. This drawing especially shows the flowchart for concentration estimation. This flowchart is different from FIG. 21 of Embodiment 2 in that at S2601 a value obtained by multiplying d(t, i, a(t)) by w(t, a(t)) is added to the total sum SUM_d of the concentration estimation values, at S2602, a value obtained by multiplying the square of d(t, i, a(t)) by w(t, i, a(t)) is added to the total sum SUM_s of the square of the concentration estimation values, and at S2603, w(t, i, a(t)) is added to the total sum SUM_w of the frequency of addition. Similarly to the existence determination, estimation is performed for the concentration estimation as well while emphasizing a time with high certainty weight.

When certainty weight is not set for the component i, estimation is enabled using certainty weight w(t, i', a(t)) of a component i' having similar volatility. This case leads to an advantage of avoiding a user's necessity of inputting a parameter for all components.

Figure 27:
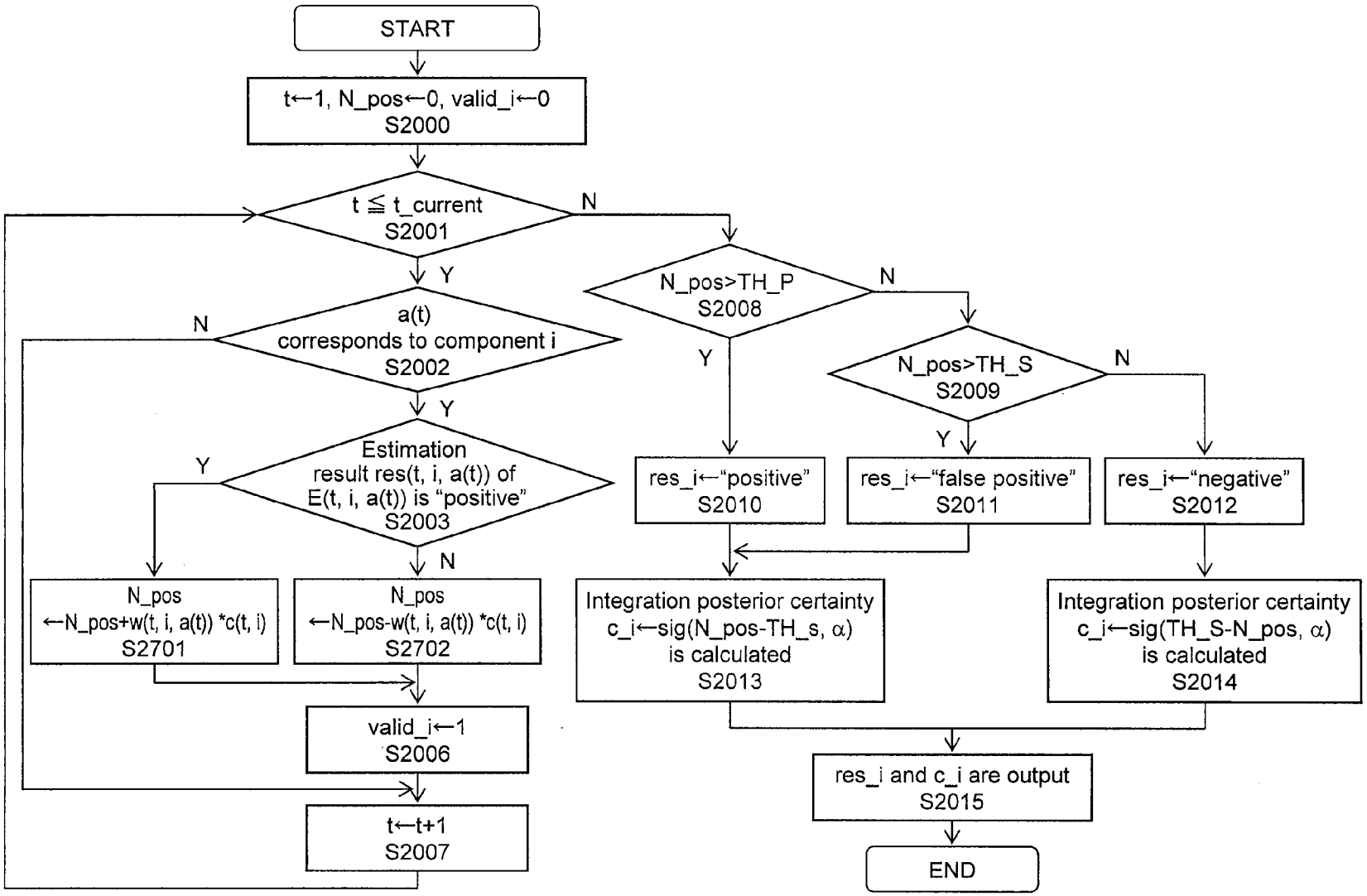
FIG. 27 is another exemplary flowchart of integration processing of the present invention.

FIG. 27 is another exemplary flowchart of the integration processing at S1905. This drawing especially shows the flowchart for existence determination. This flowchart is different from FIG. 24 in that at S2701 a value obtained by multiplying certainty weight w(t, i, a(t)) and posterior certainty c(t, i) is added to N_pos, and at S2702, a value obtained by multiplying certainty weight w(t, i, a(t)) and posterior certainty c(t, i) is subtracted from N_pos. The posterior certainty c(t, i) is calculated by Expression (6).

$$c(t, i) = sig\left(\left|\sum_{j=1}^{L} g_j \times \frac{I_j}{I_r_j} - TH(t, i, a)\right|, \gamma\right) \tag{6}$$

The posterior certainty c(t, i) means the higher degree of probability that an estimation result based on a single spectrum measured at the measurement time is correct. In this case, similarly to FIG. 24, an estimation result using a spectrum at a measurement time and of a measurement operation with high certainty weight w(t, i, a(t)) will be emphasized. Further, the posterior certainty c(t, i) used enables the emphasis of an estimation result with a high probability that an estimation result based on the single spectrum measured at the measurement time is correct. When a spectrum at each time follows a relatively simple probabilistic distribution such as a single normal distribution, the use of the posterior certainty c(t, i) enables precise estimation.

Figure 28:
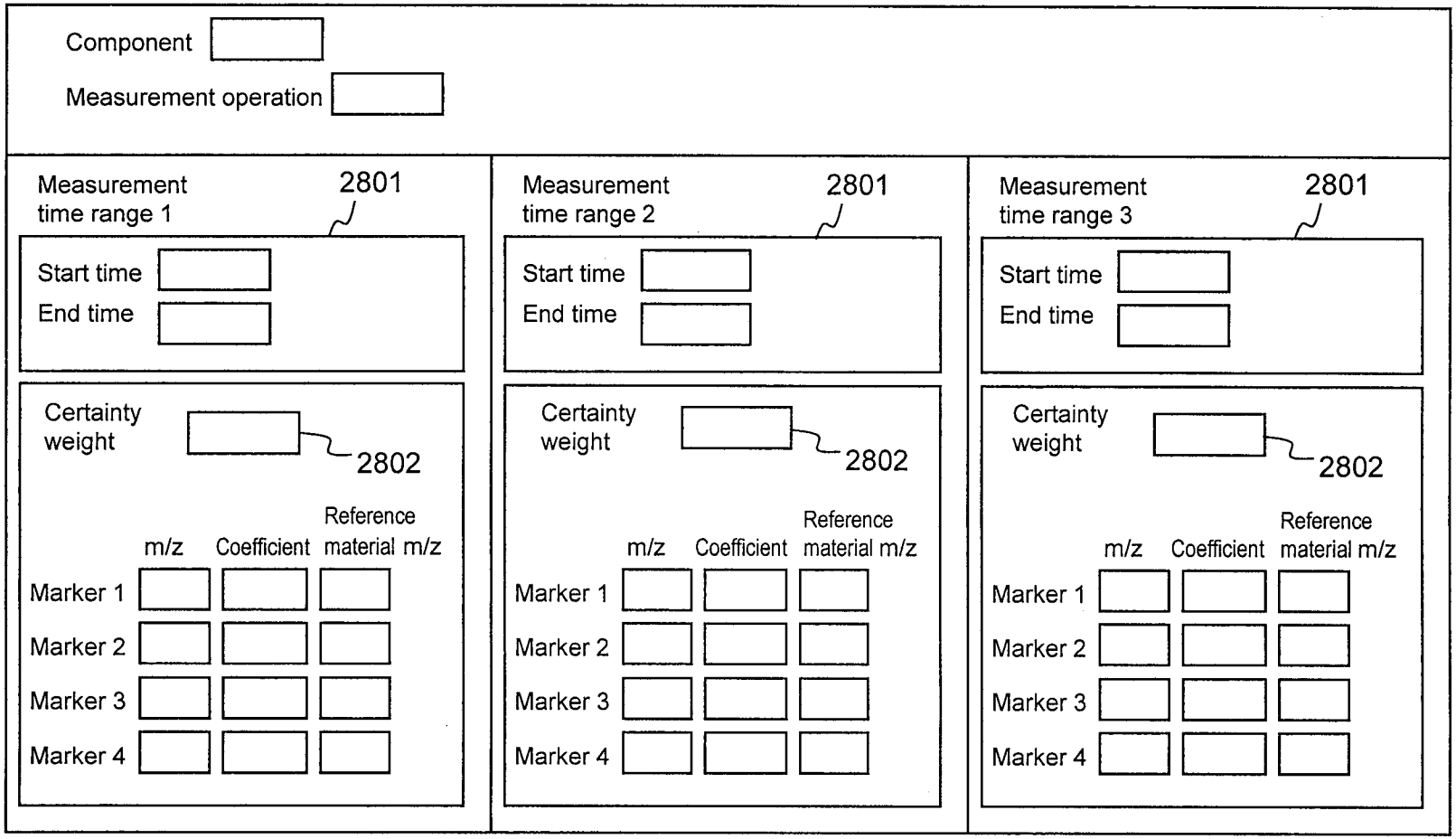
FIG. 28 shows another exemplary graphical user interface of the estimation rule input/presentation unit of the present invention.

FIG. 28 shows an exemplary graphical user interface of the estimation rule input/presentation unit 202 of the present embodiment. This example especially shows a graphical user interface enabling setting for concentration estimation. This example is different from FIG. 4 of Embodiment 1 in that a form 2801 is provided for inputting of certainty weight for each measurement time range and receiving an input 2802 of certainty weight. With this configuration, even when the precision of a content information estimation result at each measurement time tends to transition with the passage of the measurement time, an estimation rule enabling precise estimation of content information can be set. Similarly in the case of existence determination as well, an input form for certainty weight may be provided.

FIG. 29 shows a data structure of the estimation rule database 203 of the present embodiment. This drawing especially shows an estimation rule for concentration estimation. This example is different from FIG. 7 of Embodiment 1 in that a column 2901 of certainty weight is provided for each group of a measurement time, a component and a measurement operation. Thereby, even when the precision of a content information estimation result at each measurement time tends to transition with the passage of the measurement time, an estimation rule enabling precise estimation of content information can be stored.

According to the present embodiment, even when the precision of a content information estimation result at each measurement time tends to transition with the passage of the measurement time, content information can be estimated precisely.

Embodiment 4

The present embodiment describes an exemplary mass spectrometric system capable of precisely estimating content information of a plurality of components at the same time even when the precision of a content information estimation result at each measurement time tends to transition with the passage of the measurement time.

After all of the component as a measurement target vaporizes, the measurement thereof is no longer possible. Therefore, measurement is possible only within a limited time. When a plurality of components are to be estimated at the same time, there is a need to effectively select a measurement operation to be executed at each time. According to the present embodiment, a measurement operation can be selected effectively, and so content information can be estimated precisely.

Figure 30:
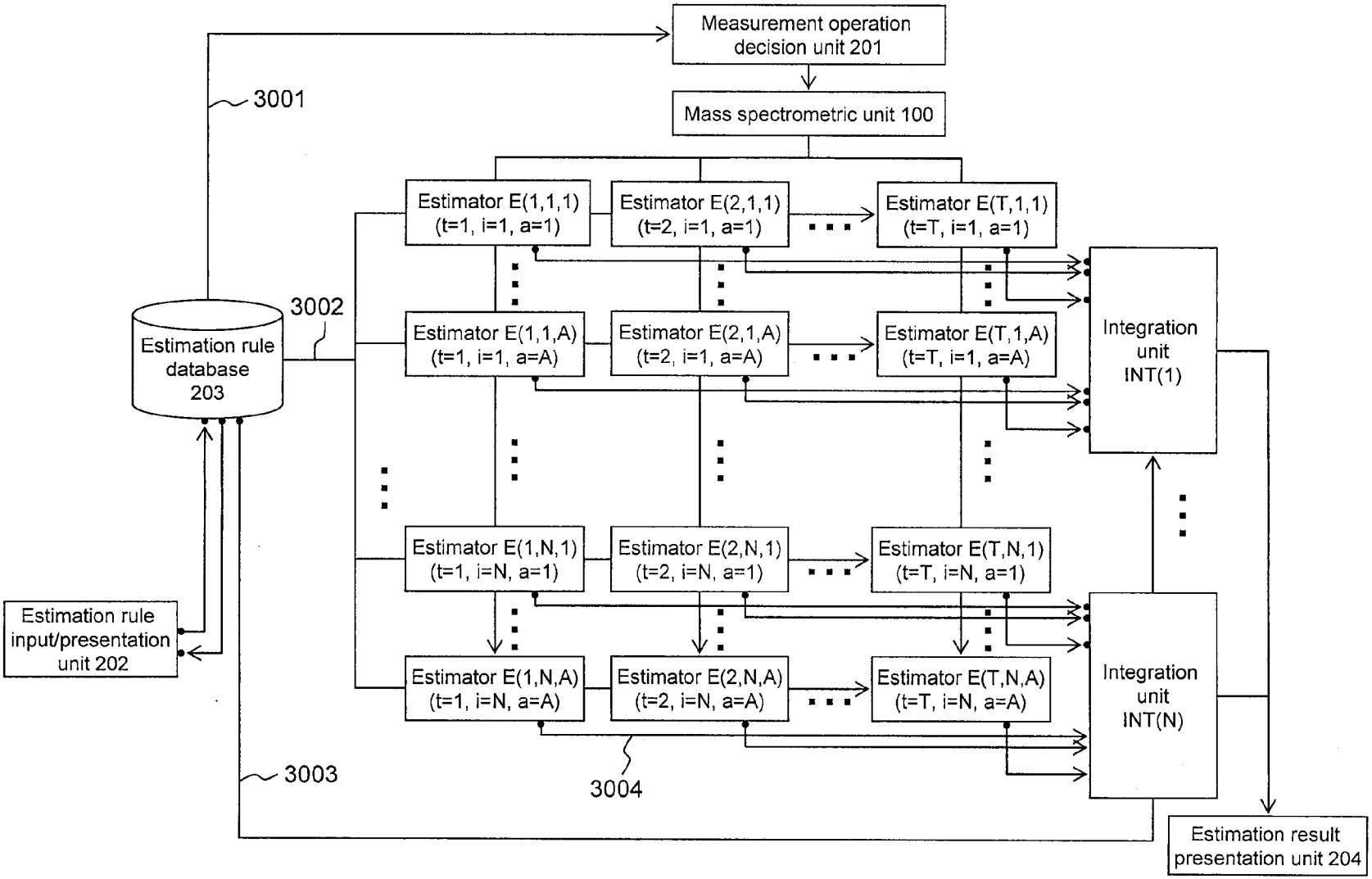
FIG. 30 shows another exemplary processing block configuration of a mass spectrometric system of the present invention.

FIG. 30 shows a processing block configuration of the mass spectrometric system 111 of the present embodiment. The configuration is different from Embodiment 3 in that certainty weight 3001 corresponding to each measurement time, each component and each measurement operation on the estimation rule database 203 is input to the measurement operation decision unit 201, and the measurement operation decision unit 201 decides a measurement operation using the certainty weight. An estimation rule and certainty weight corresponding to each time, each component and each measurement operation are input to the estimation rule database 203 from the estimation rule input/presentation unit 202. Each estimator receives, from the estimation rule database 203, an estimation rule 3002 corresponding to each time, each component and each measurement operation, and each integration unit receives, from the estimation rule database 203, certainty weight 3003 corresponding to each component and time. Each estimator inputs an estimation result 3004 corresponding to each time, each component and each measurement operation to the corresponding integration unit. The present embodiment follows the same flowchart FIG. 19 as in Embodiment 2.

Figure 31:
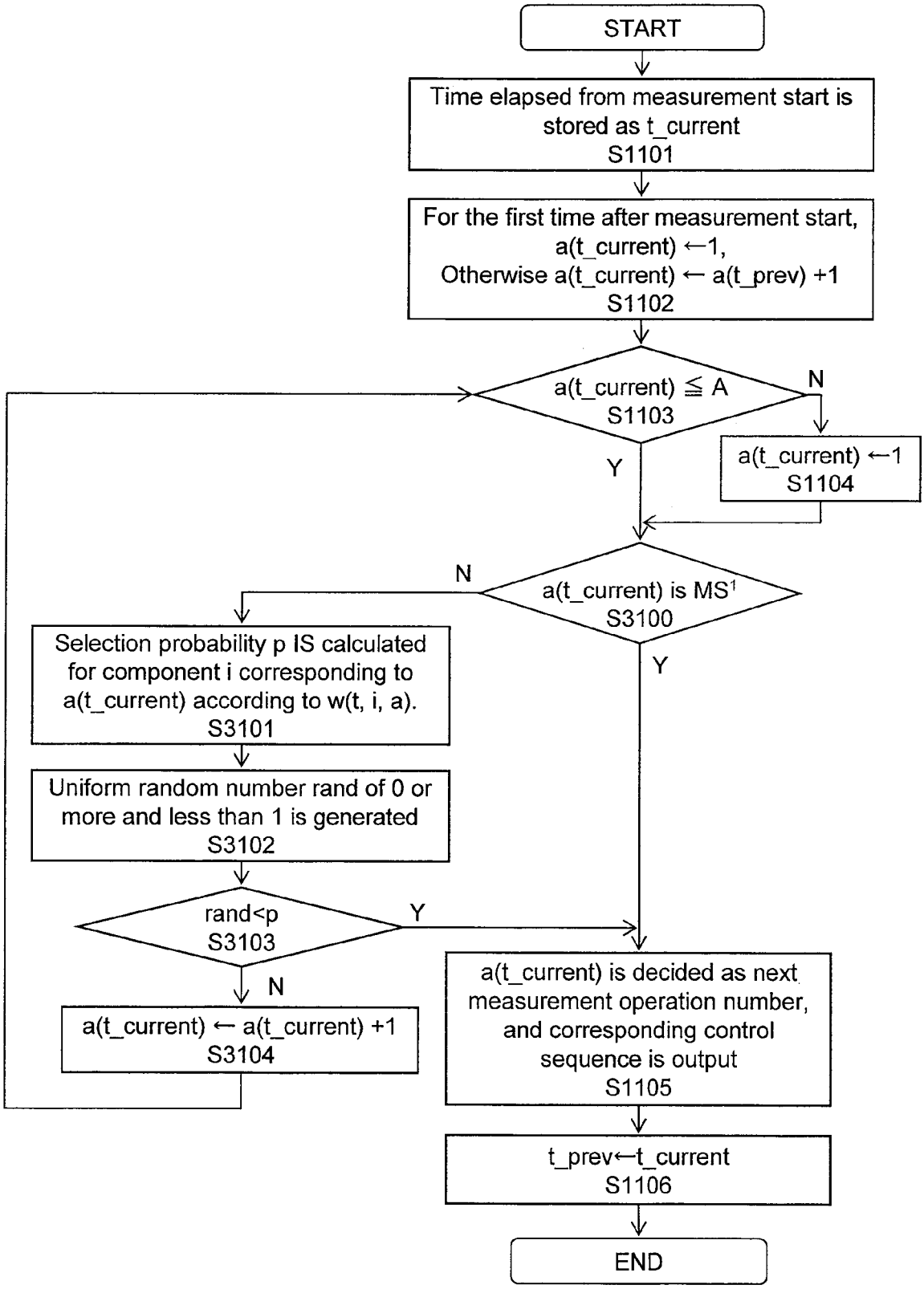
FIG. 31 is another exemplary flowchart of measurement operation decision processing of the present invention.

FIG. 31 is a flowchart of the measurement operation decision processing at S304 of the present embodiment. The following describes a difference from FIG. 11 of Embodiment 1. At S3100, determination is made whether a(t_current) is $MS^1$ or not. When it is $MS^1$, the procedure proceeds to S1105, and otherwise the procedure proceeds to S3101. At S3101, selection probability p is calculated for the component i corresponding to a(t_current) in accordance with the certainty weight w(t, i, a). For instance, let that p=w(t, i, a). Next, at S3102, a uniform random number rand of 0 or more and less than 1 is generated. Next, at S3103, when rand is less than p, the procedure proceeds to S1105, and otherwise at S3104, 1 is added to the measurement operation number a(t_current) to set the following measurement operation number as a target, and the procedure returns to S1103.

At this time, a measurement operation corresponding to a component with larger certainty weight w(t, i, a) leads to higher probability that rand is less than p, and therefore such a measurement operation is more likely to be selected as the next measurement operation. Thereby, when the precision of a content information estimation result at each measurement time tends to transition with the passage of the measurement time, a measurement operation will be executed preferentially for a measurement time and component with higher-degree of precision of the content information estimation result, and therefore content information can be estimated precisely. Further the measurement time can be shortened.

When certainty weight is not set for the component i, estimation is enabled using certainty weight w(t, a(t)) of a component i' having similar volatility. This case leads to an advantage of avoiding a user's necessity of inputting a parameter for all components.

Figure 32:
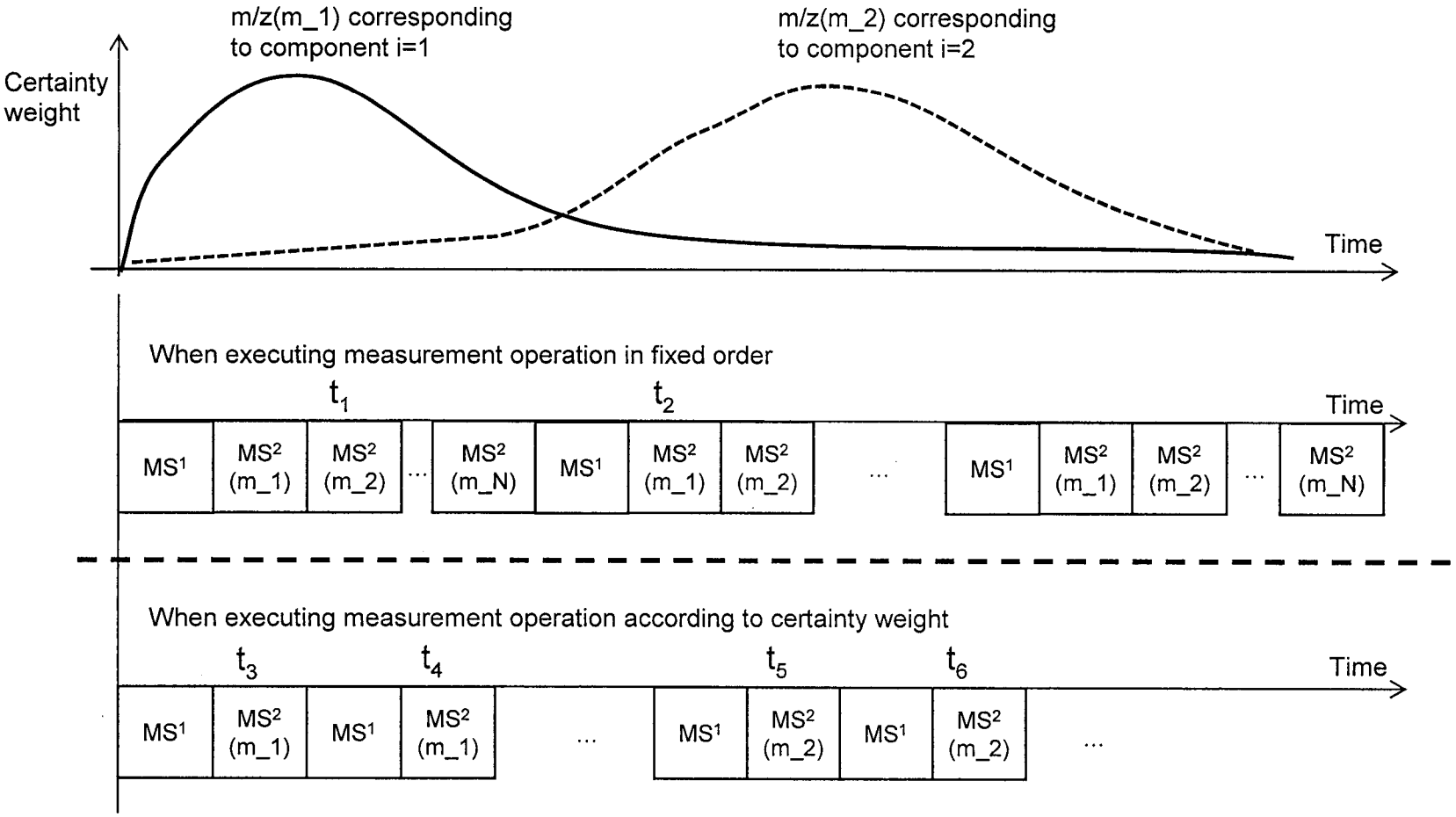
FIG. 32 schematically shows the effect from measurement operation decision processing of the present invention.

FIG. 32 schematically shows the effect from the measurement operation decision processing S304 of the present embodiment. When measurement is performed in a fixed order, a measurement operation is uniformly executed for components even at a time with low-degree of precision of the content information estimation result. As a result, components may vaporize before sufficient estimation precision can be obtained. In the example of the drawing, a component i=2 of low volatility is measured at time $t_1$ and a component i=1 of high volatility is measured at time $t_2$. Therefore, precision may be degraded. Further estimation precision obtained in the same measurement time may be low.

On the other hand, according to the present embodiment, in the example of the drawing, for example, the component i=1 of high volatility is preferentially measured at time $t_3$ and time $t_4$, and the component i=2 of low volatility is preferentially measured at time $t_5$ and time $t_6$. When a measurement operation is executed in accordance with certainty weight as in the present embodiment, a component with high-degree of precision of the content information estimation result is preferentially measured at each measurement time, and therefore there is a high possibility that estimation can be completed before the component vaporizes. Further, estimation precision obtained in the same measurement time becomes high.

According to the present embodiment, even when the precision of a content information estimation result at each measurement time tends to transition with the passage of the measurement time, content information of a plurality of components can be estimated precisely and at the same time.

Embodiment 5

The present embodiment describes an exemplary mass spectrometric system enabling automatic learning of an estimation rule and certainty weight.

Figure 33:
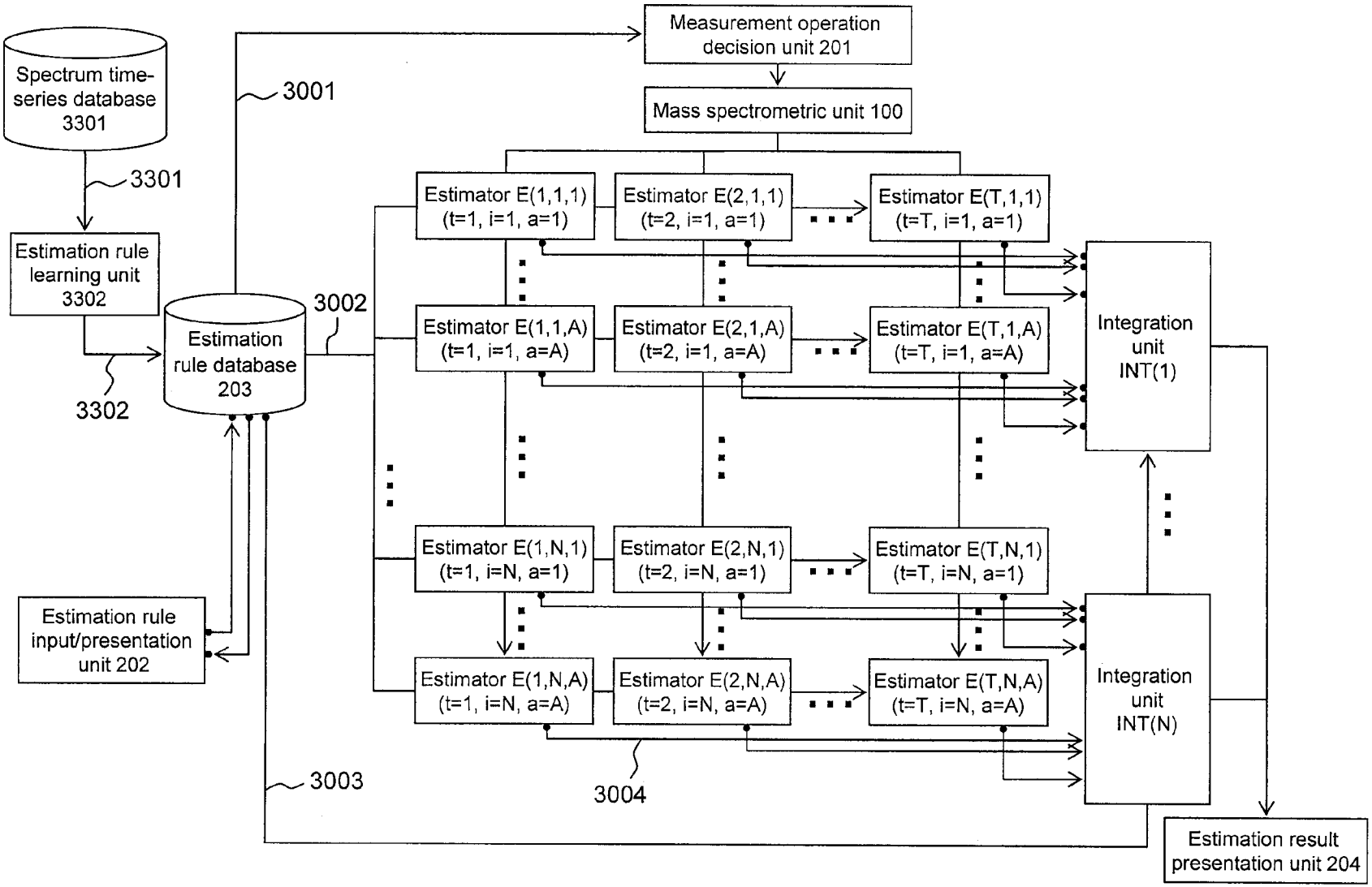
FIG. 33 shows another exemplary processing block configuration of a mass spectrometric system of the present invention.

FIG. 33 shows a processing block configuration of the mass spectrometric system 111 of the present embodiment. The configuration is different from Embodiment 4 in that a spectrum time series 3301 is read from a spectrum time-series database 3301, and an estimation rule learning unit 3302 estimates an estimation rule and certainty weight 3302 corresponding to each measurement time, each component and each measurement operation. The flowchart during measurement execution of the present embodiment follows the same flowchart FIG. 19 as in Embodiment 2. The following describes processing during learning.

Figure 34:
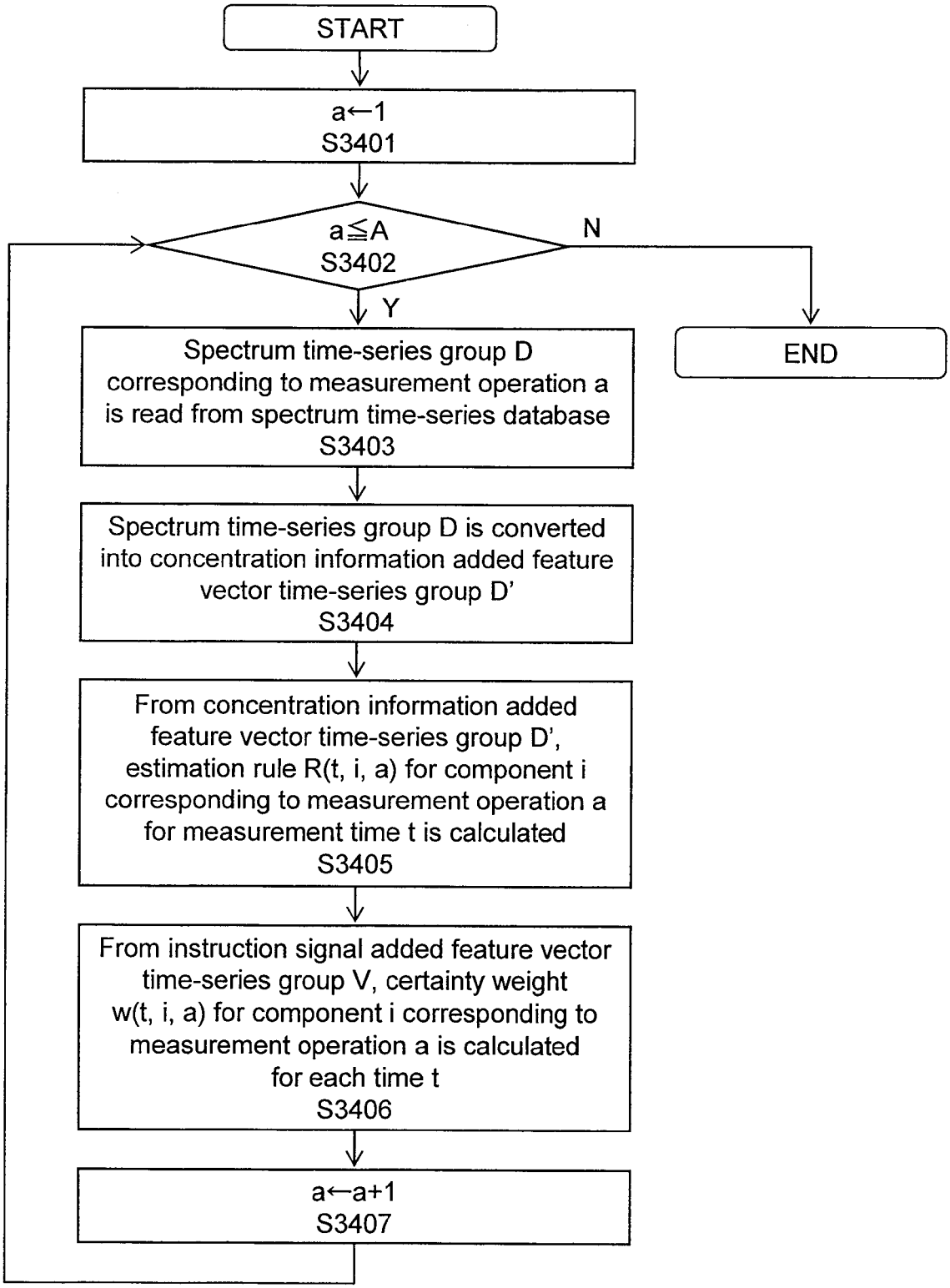
FIG. 34 is an exemplary operation flowchart of an estimation rule learning unit of the mass spectrometric system of the present invention.

FIG. 34 is a flowchart showing an operation of an estimation rule learning unit. This flowchart especially shows the case for concentration estimation.

Firstly at S3401, 1 is stored as a measurement operation number a. When a is A or less at S3402, the procedure proceeds to S3403, and otherwise the procedure ends. At S3403, a spectrum time-series group D corresponding to the measurement operation a is read from the spectrum time-series database 3301. Next at S3404, the spectrum time-series group D is converted into a concentration information added feature vector time-series group D'. Next at S3405, from the concentration information added feature vector time-series group D', an estimation rule R(t, i, a) for the component i corresponding to the measurement operation a for each measurement time t is calculated. This estimation parameter may be calculated by a known calculation method of a calibration curve. For instance, a known method such as linear regression, polynomial regression, support vector machine regression or relevance vector machine regression may be used. Next, at S3406, from an instruction signal added feature vector time-series group V, certainty weight w(t, i, a) for the component i corresponding to the measurement operation a is calculated for each time t. The certainty weight w(t, i, a) is calculated by w(t, i, a)=exp(—βS) based on the total sum S of deviations from the calibration line obtained by regression of each spectrum with R(t, i, a). Next, at S3407, 1 is added to a, and the procedure returns to S3402.

Figure 35:
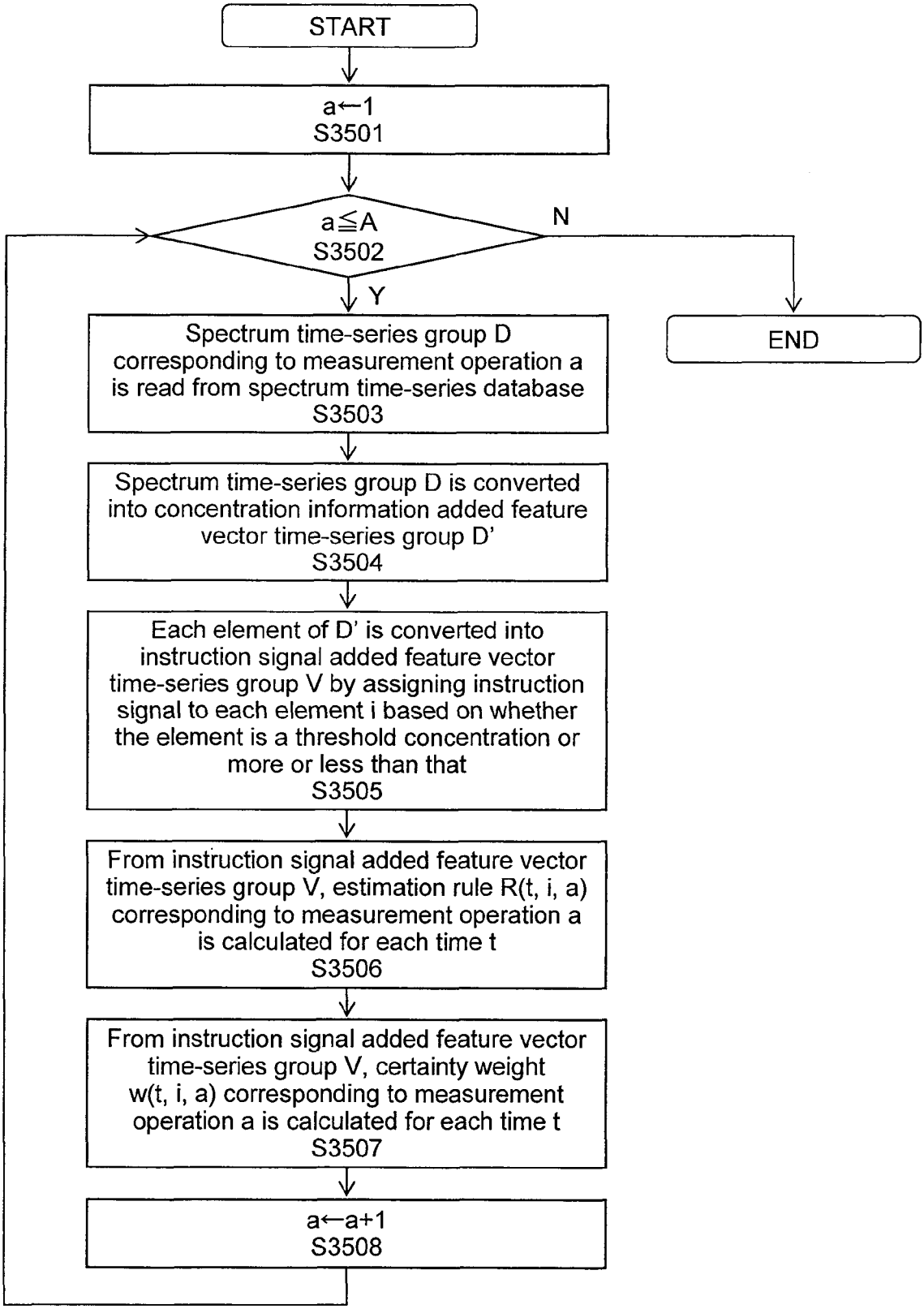
FIG. 35 is another exemplary operation flowchart of an estimation rule learning unit of the mass spectrometric system of the present invention.

FIG. 35 is a flowchart showing the operation of the estimation rule learning unit. This flowchart especially shows the case for existence determination. The processing from S3501 to S3504 of FIG. 35 is the same as the processing from S3401 to S3404 of FIG. 34, and S3508 is the same processing as that at S3407.

The following describes a difference from FIG. 34. At S3505, the concentration information added feature vector time-series group D' is converted into the instruction signal added feature vector time-series group V by assigning an instruction signal to each element i based on whether the element is a threshold concentration or more or less than that for each component i. Next at S3506, from the instruction signal added feature vector time-series group V, an estimation rule R(t, i, a) corresponding to the measurement operation a is calculated for each time t. This estimation parameter may be calculated by a known supervised pattern recognition learning method. For instance, a known method such as linear discriminant analysis, back propagation method of neural network, support vector machine sorter, relevance vector machine sorter or ID3 or C4.5 of decision tree may be used. Next at S3507, from the instruction signal added feature vector time-series group V, certainty weight w(t, i, a) for the component i corresponding to the measurement operation a is calculated for each time t. The certainty weight w(t, i, a) may be calculated as an accuracy rate when all samples of the measurement time t, the component i and the measurement operation a are determined with the estimation rule R(t, i, a). Alternatively, a known index such as between-class variance versus within-class variance, where a larger index makes the determination easier, may be used.

The present embodiment enables automatic learning of an estimation rule and certainty weight.

Embodiment 6

The present embodiment describes an exemplary mass spectrometric system capable of precisely estimating content information of a plurality of components at the same time when the precision of a content information estimation result at each measurement time tends to transition with the passage of the measurement time, and there is a variation in measurement time required for estimation among components.

When there is a variation in measurement time required for estimation among components, a precise estimation result can be obtained for a part of components even in a relatively short time. In that case, an unnecessary operation will be executed for the component after the precise estimation result has been obtained, and measurement in a long time will be required as a whole. The present embodiment deals with this problem by performing feedback of an estimation result integrated up to the current time to a measurement operation decision unit.

Figure 36:
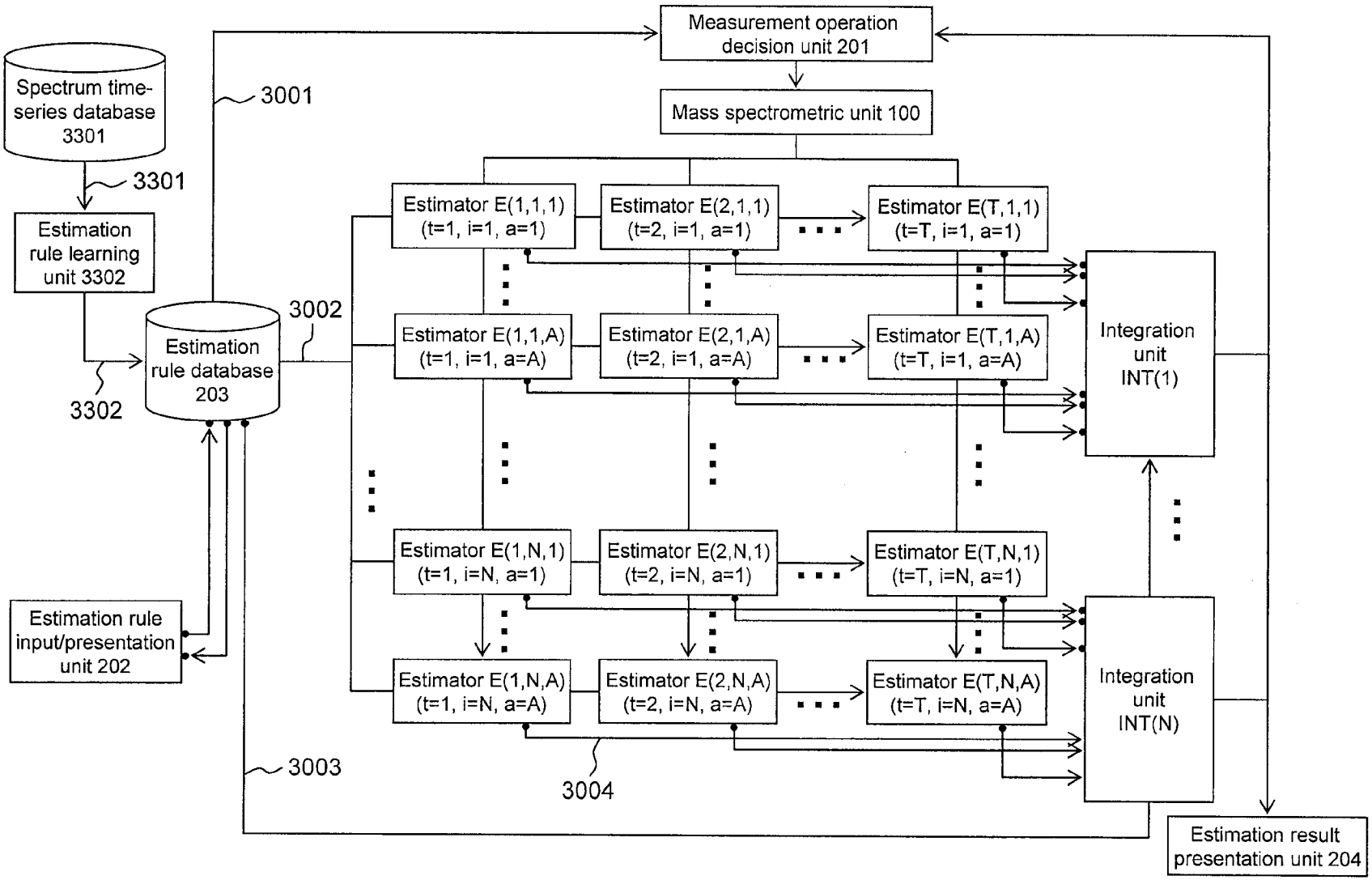
FIG. 36 shows another exemplary processing block configuration of a mass spectrometric system of the present invention.

FIG. 36 shows a processing block configuration of the mass spectrometric system 111 of the present embodiment. The configuration is different from Embodiment 5 in that an estimation result d_i or res_i for each component i output from the integration unit INT(i) and posterior certainty c_i are input to the measurement operation decision unit 201 and the measurement operation decision unit 201 decides a measurement operation in accordance with them.

Figure 37:
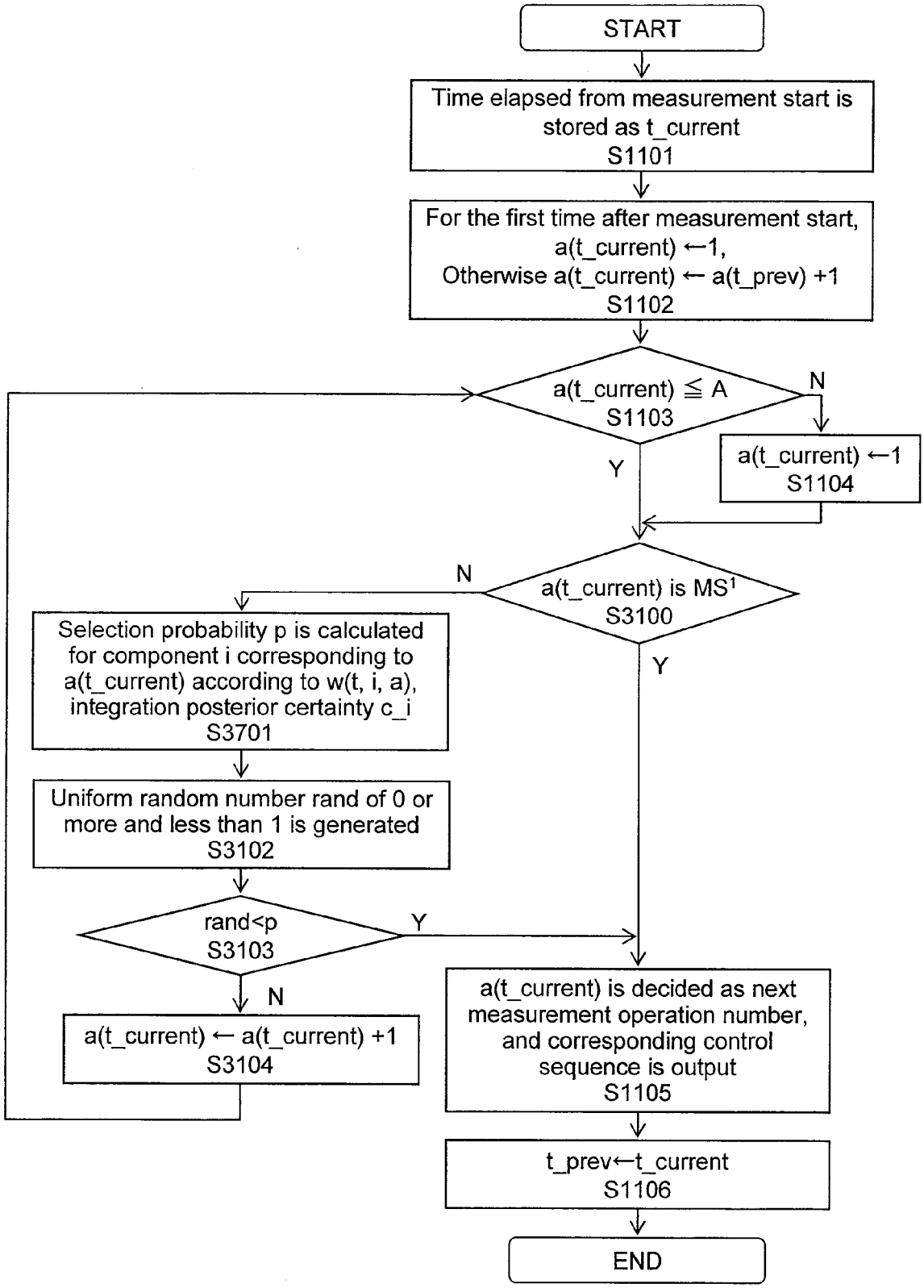
FIG. 37 is an exemplary flowchart of measurement operation decision processing of the present invention.

FIG. 37 is a flowchart of the measurement operation decision processing at S304 of the present embodiment. This flowchart is different from FIG. 31 of Embodiment 4 in that selection probability is calculated at S3701. Selection probability p is calculated for the component i corresponding to a(t_current)) in accordance with Expression (7) based on the certainty weight w(t, i, a) and integration posterior certainty c_i. Herein q is an appropriate positive constant.

$$p=w(t,i,a)\times(1-c_i)^q \tag{7}$$

At this time, higher certainty weight w(t, i, a) means higher probability of selection, and higher integration posterior certainty c_i means lower probability of selection. Thereby, when the precision of a content information estimation result at each measurement time tends to transition with the passage of the measurement time, a measurement operation is preferentially executed for a measurement time and a component with high-degree of precision of the content information estimation result. After that, a component with low integration posterior certainty c_i is preferentially processed. As a result, high-degree of precision for measurement and reduction in the frequency of measurement of a component already having a precise estimation result both can be achieved. Therefore, even when the precision of a content information estimation result at each measurement time tends to transition with the passage of the measurement time, and there is a variation in measurement time required for estimation among components, content information of a plurality of components can be estimated precisely and at the same time.

Figure 38:
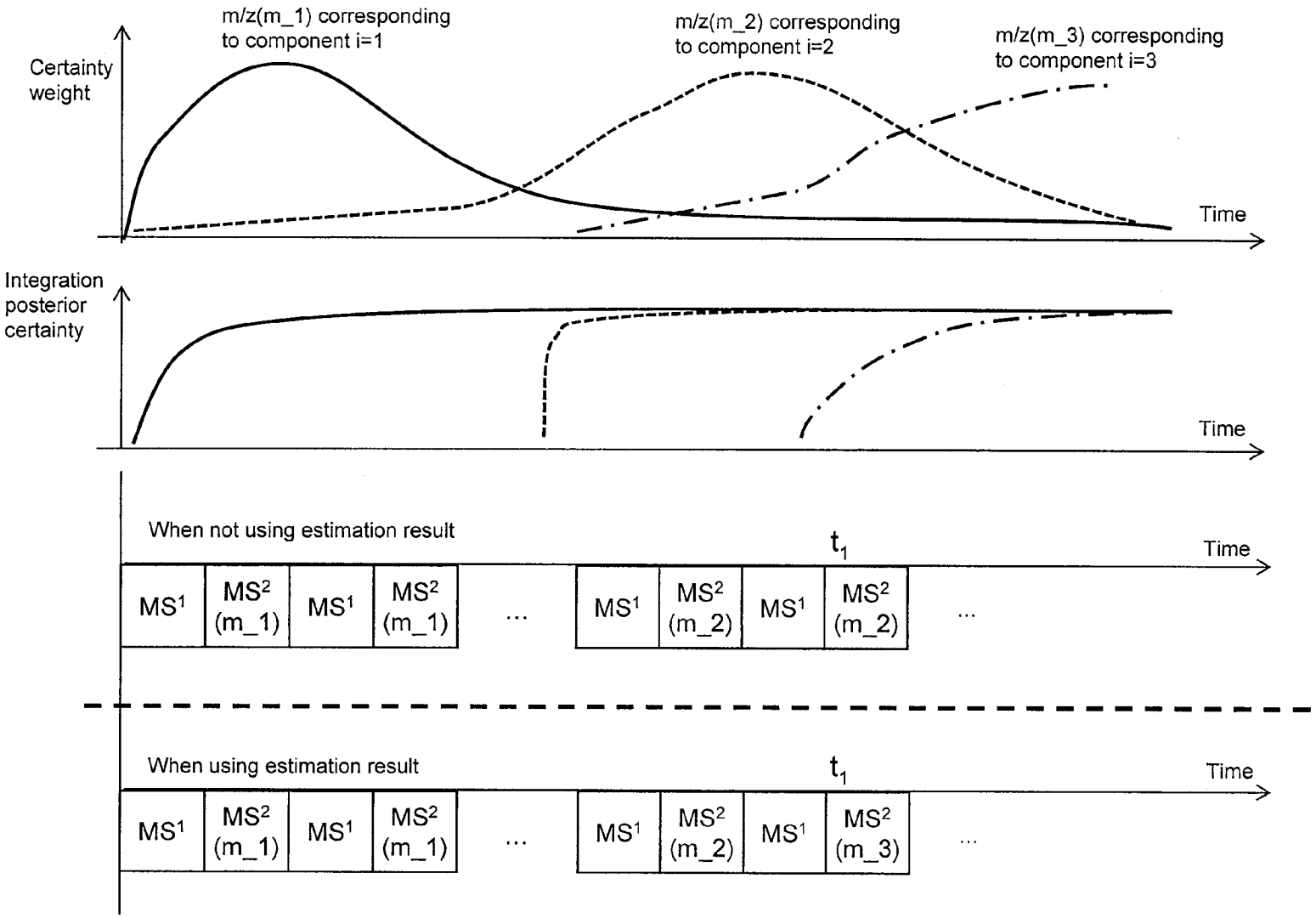
FIG. 38 schematically shows the effect from measurement operation decision processing of the present invention.

FIG. 38 schematically shows the effect from the measurement operation decision processing S304 of the present embodiment. When feedback of an estimation result is not performed, the procedure simply follows certainty weight. Therefore, even at time $t_1$ when an estimation result having sufficiently high integration posterior certainty, i.e., a precise estimation result has been found for the component i=2, measurement is performed for the component i=2 because the component i=2 has high certainty weight. On the other hand, when feedback of an estimation result is performed, i.e., when a measurement operation is executed in accordance with certainty weight and integration posterior certainty as in the present embodiment, at time $t_1$, a component i=3 with low integration posterior certainty c_i is immediately measured instead of the component i=2 already having high integration posterior certainty c_i. In this way, the frequency of measurement of a component already having a precise estimation result is reduced, whereby even when there is a variation in measurement time required for estimation among components, content information of a plurality of components can be estimated precisely and at the same time.

According to the present embodiment, content information of a plurality of components can be estimated precisely and at the same time when the precision of a content information estimation result at each measurement time tends to transition with the passage of the measurement time, and there is a variation in measurement time required for estimation among components.

Embodiment 7

The present embodiment describes an exemplary mass spectrometric system capable of precisely estimating content information even when a long time is required from acquisition of a specimen to measurement start.

When a long time is required from acquisition of a specimen to measurement start, components in the specimen vaporize to some extent before the measurement start, and therefore it is difficult to select an estimator based on the measurement time. The present embodiment deals with this problem by correcting a measurement time in accordance with an elapsed time from acquisition of a specimen to measurement start.

Figure 39:
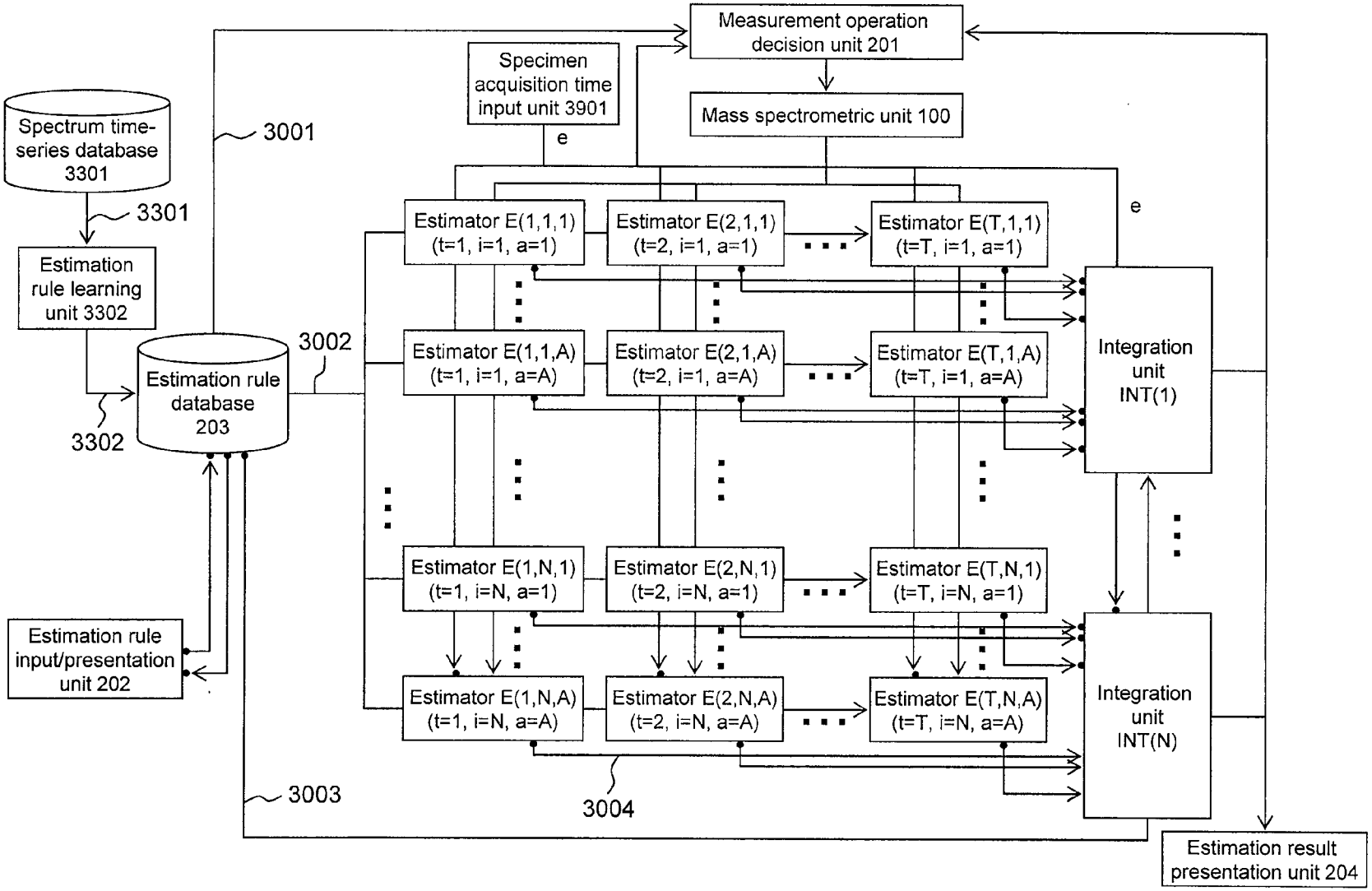
FIG. 39 shows an exemplary processing block configuration of a mass spectrometric system of the present invention.

FIG. 39 shows a processing block configuration of the mass spectrometric system 111 of the present embodiment. The configuration is different from Embodiment 6 in that a specimen acquisition time input unit 3901 exists to accept the input of a specimen acquisition time and output an elapsed time from the specimen acquisition, and elapsed time e from the specimen acquisition is input to each estimator E(t, i, a). Then, the elapsed time e is added to the current measurement time t_current for correction as in t_current'=t_current+w exe. Herein, w e is an appropriate constant. The measurement operation decision unit 201 and the integration unit INT(i) also performs addition to t_current similarly for correction. An estimation rule and a certainty weight to be used are selected in accordance with the thus corrected t_current'.

FIG. 40 shows a graphical user interface of the specimen acquisition time input unit 3901. In this way, the input of specimen acquisition time is accepted, whereby even when conditions for specimen acquisition and measurement conditions are different, a measurement time can be corrected accordingly, so that an optimum estimation rule and certainty weight can be selected. The specimen acquisition time may be input at the specimen acquisition time using a depression button on a touch panel, or may be input using a button provided at a dropper used for specimen acquisition, or other devices may be used instead.

According to the present embodiment, content information can be estimated precisely even when a long time is required from acquisition of a specimen to measurement start.

Note here that the present invention is not limited to the above-described embodiments, and may include various modification examples. For instance, the entire detailed configuration of the embodiments described above for explanatory convenience is not always necessary for the present invention. A part of one embodiment may be replaced with the configuration of another embodiment, or the configuration of one embodiment may be added to the configuration of another embodiment. A part of the configuration of each embodiment may additionally include another configuration, or a part of the configuration may be deleted or replaced.

The above-described configurations, functions, processing parts, processing means and the like, a part or the entire of them, may be implemented by hardware by designing as an integrated circuit, for example. Alternatively, the above-described configurations, functions and the like may be implemented by software using a processor that interprets a program to implement these functions and executes the program. Information such as programs, tables and files to implement these functions may be placed on a recording device such as a memory, a hard disk or a SSD (Solid State Drive), or a recording medium such as an IC card, a SD card or a DVD.

Control lines and information lines shown are those required for description, and all of the control line and information lines of a product are not always illustrated. It can be considered that in an actual product, almost all configurations are mutually connected.

What is claimed is:

1. A mass spectrometric system, comprising:

a mass spectrometric unit that measures a specimen and outputs a mass spectrum; and an estimator that has an estimation rule on content information, the estimation rule being assigned to each component of a plurality of components that may be contained in the specimen and each measurement time of a plurality of measurement times, each of which is a time elapsed from a start of a measurement of the specimen, wherein the estimator estimates, based on a mass spectrum output from the mass spectrometric unit, content information on each component in accordance with the estimation rule, the estimation rule is defined as $$res(t, i, a) == \begin{cases} \text{Positive} & \text{if } \sum_{j=1}^{L} g_j \times \frac{I_j}{I_r_j} > TH(t, i, a), \\ \text{Negative} & \text{otherwise,} \end{cases}$$

where t is a measurement time, i is a component, a is a measurement operation, res (t, i, a) is the content information indicating an existence determination result, j is an index corresponding to a marker such that the magnitude of a peak is stored at the intensity of the marker, L is the number of markers, I_j is the intensity of the marker j corresponding to the magnitude of a peak, g_1, . . . , g_L are a marker coefficient set, r_1, . . . , r_L are m/z of a reference material set, where m is mass and z is charge number, I_r_1, . . . , I_r_L are intensities of m/z of the reference material, and TH (t, i, a) is a threshold, and an output of the estimator is the content information including a logical value indicating whether a concentration of a target component exceeds a threshold concentration or not.

2. The mass spectrometric system according to claim 1, further comprising:

an estimation rule presentation user interface that presents the estimation rule on content information on each component and each measurement time.

3. The mass spectrometric system according to claim 2, wherein the estimation rule presentation user interface accepts an input of the estimation rule on content information on each component and each measurement time.

4. The mass spectrometric system according to claim 1, further comprising:

an integration estimation unit assigned to each component, wherein the integration estimation unit integrates estimation results on content information of a plurality of measurement times, each estimation result including content information relating to a component of the specimen for a measurement time and being output from the estimator, and the integration estimation unit outputs the integrated estimation result.

5. The mass spectrometric system according to claim 4, wherein a certainty weight corresponds to each component and each measurement time, and the integration estimation unit integrates estimation results that are output from the estimator in accordance with the certainty weight.

6. The mass spectrometric system according to claim 5, further comprising a measurement operation decision unit that decides a measurement operation at each measurement time on a basis of the certainty weight, wherein the mass spectrometric unit executes a measurement operation output from the measurement operation decision unit.

7. The mass spectrometric system according to claim 1, further comprising:

a mass spectrum database that stores a mass spectrum with a corresponding measurement time; and an estimation rule learning unit that learns a parameter of an estimator corresponding to each component and each measurement time on a basis of the mass spectrum database.

8. The mass spectrometric system according to claim 7, further comprising: a certainty weight learning unit that learns certainty weight that is a value in accordance with a probability that estimation by the estimator becomes correct.

9. The mass spectrometric system according to claim 1, further comprising:

a specimen acquisition time input unit that accepts an input of an elapsed time from specimen acquisition or a specimen acquisition time, wherein the specimen acquisition time input unit corrects a measurement time on a basis of the elapsed time from specimen acquisition or the specimen acquisition time.

* * * * *